US005848982A

United States Patent [19]

Hoshino et al.

[11] Patent Number: 5,848,982

[45] Date of Patent: Dec. 15, 1998

[54] LOUNGER-TYPE AIR MASSAGER

[75] Inventors: Shoji Hoshino; Koichi Abe; Mikio Mochida; Hiromitsu Ichikawa; Katumi Inaba, all of Kanagawa, Japan

[73] Assignee: Kabushiki Kaisha TEC, Shizuoka-ken, Japan

[21] Appl. No.: 737,768

[22] PCT Filed: Mar. 19, 1996

[86] PCT No.: PCT/JP96/00722

§ 371 Date: Nov. 14, 1996

§ 102(e) Date: Nov. 14, 1996

[87] PCT Pub. No.: WO96/29042

PCT Pub. Date: Sep. 26, 1996

[30] Foreign Application Priority Data

Mar. 20, 1995 [JP] Japan ..... 7-060596
Mar. 28, 1995 [JP] Japan ..... 7-069880

[51] Int. Cl.[6] ..... A61H 9/00

[52] U.S. Cl. ..... 601/150

[58] Field of Search ..... 601/148–150, 601/98, 88, 96, 90; 297/452.41, DIG. 3

[56] References Cited

U.S. PATENT DOCUMENTS 3,595,223 7/1971 Castagna .
3,613,671 10/1971 Poor .
5,611,772 3/1997 Fujimoto et al. ..... 601/149

FOREIGN PATENT DOCUMENTS 270699 6/1988 European Pat. Off. ..... 601/148
60-106626 7/1985 Japan .
2-182255 7/1990 Japan .
3-41185 6/1991 Japan .

*Primary Examiner*—Danton D. DeMille
*Attorney, Agent, or Firm*—Frishauf, Holtz, Goodman, Langer & Chick

[57] ABSTRACT

A lounger-type air manager comprises a lounger body (1) including a seat portion (2) and a backrest portion (3) provided on the rear end of the seat portion, bags (4, 5, 10) provided in the seat portion and the backrest portion and adapted to inflate and deflate when compressed air is fed thereinto and discharged therefrom, and a compressed air control device (11) for controlling the feed and discharge of the compressed air into and from the bags. The bag in the seat portion is fixed at its rear edge portion on the backrest side to the seat portion, and the bag in the backrest portion is fixed at its upper end portion to the backrest portion. The compressed air control device (50, 50', 50", 50'") changes the charging time or exhaust time for the compressed air, the capacity of each bag, or the flow resistance of a charging/exhaust pipe for each bag so as to make the bag (35, 39) among the bags, which is subjected to a heavier load from the body weight of a person seated on the lounger body (30) than the other bag **(34, 36*a*, 36*b*, 37*a*, 37*b*, 38*a*, 38*b*, 41*a*, 41*b*, 42*a*, 42*b*)**, has the same inflation as the inflation of the other bag after the feed of the compressed air into those bags is finished.

16 Claims, 11 Drawing Sheets

LOUNGER-TYPE AIR MASSAGER

TECHNICAL FIELD

The present invention relates to a lounger-type air massager in which bags are set at predetermined positions in a lounger and are inflated and deflated as compressed air is fed into and discharged from them, so that the body of a user seated on the lounger is intermittently pressed to be massaged by the bags.

BACKGROUND ART

A lounger-type air massager of the aforesaid type has been made to be known by Jpn. Pat. Appln. KOKOKU Publication No. 3-41185, for example. In this conventional lounger-type air massager, the whole outer surface of the seat back (backrest portion) of a lounger is formed to have the shape of a physiologically curved surface that substantially fits the curvature of the vertebral column of the human body. A plurality of elongated small projections each of which has a round cross section are arranged along the physiologically curved surface, each of the projections extending substantially all over the width of the backrest portion. Elongated small projections each of which has a round cross section are further arranged in the seat portion of the lounger at positions corresponding to the buttocks and thighs of the body of a person seated on the seat portion, each of the projections extending substantially all over the width of the seat portion. Bags capable of inflation and deflation are arranged individually on these projections, and feed of compressed air into these bags is repeatedly started and stopped while a user is seated on the lounger-type air massager. When the compressed air is fed into those bags during this repetition, the bags inflate and press the body of the user seated on the lounger. When the feed of the compressed air into those bags is stopped, the bags are pressed by the weight of the aforesaid body, so that the air in the bags is discharged, whereupon the bags deflate. The pressurization and depressurization of the user's body, caused by such inflation and deflation of the bags, produces a massage effect for the user's body.

In the lounger-type air massager described in Jpn. Pat. Appln. KOKOKU Publication No. 3-41185, these bags are fixed to the opposite ends of the backrest portion and those of the seat portion in their width direction by fixing means, such as adhesion or welding (see the 8th to 13th lines of the left column on the 4th page and FIGS. 5*a* and 5*b* of the aforesaid KOKOKU Publication).

Jpn. Pat. Appln. KOKOKU Publication No. 3-41185 further describes that the shape of the projecting end of each of the aforesaid projections is selected in order to set a direction in which the body is pressed by each of the inflated bags with a maximum massage effect (see the 4th to 11th lines of the right column on the 4th page and FIG. 13 of the aforesaid KOKOKU Publication). To this end, the rear-end-side (i.e., backrest-side) slope of each projection of the seat portion is made gentler than the front-end-side (i.e., side opposite to the backrest side) slope, and the bag is placed on the gentler rear-end-side slope. When compressed air is fed into this bag, the bag inflates diagonally upward and rearward, that is, in a direction substantially perpendicular to its corresponding gentler slope, and presses the thighs and buttocks of the body of the person seated on the seat portion diagonally upward and rearward. Thereupon, the body of the person seated on the seat portion meets with resistance from the backrest portion, so that the massage effect of the bags on the seat portion for the thighs and buttocks of the body is improved.

In the lounger-type air massager described in Jpn. Pat. Appln. KOKOKU Publication No. 3-41185, however, the person seated on the lounger-type air massager can perceive the projecting ends of a plurality of projections on the seat portion and the backrest portion when the bags deflate. Accordingly, the seated person suffers an unnatural sense, and cannot be seated at ease on the lounger-type air massager.

In the lounger-type air massager described in Jpn. Pat. Appln. KOKOKU Publication No. 3-41185, moreover, since each of the bags is fixed to the opposite ends of the backrest portion and the seat portion in their width direction by the fixing means, such as adhesion or welding, the displacement of the upper surface of each bag is restricted when the bag deflates or inflates. Thus, each bag can produce only a small massage effect for its capacity, so that the operating efficiency of the lounger-type air massager is low.

In the conventional lounger-type air massager, moreover, although each of the bags is not subjected with the same load from the body weight of the seated person, all of the bags have substantially the same capacity, all of compressed air charging pipes and compressed air exhaust pipes connected to these bags have the same diameter, the bags use a common supply source for compressed air, and all compressed air charging times and compressed air non-charging or exhaust times for the bags are controlled at the same values.

In the conventional lounger-type air massager, therefore, the inflatable bags can not produce appropriate pressing forces for corresponding parts of the body of the seated person in response to the load applied from the body weight of the seated person to each of the bags, so that it is difficult for the seated person to obtain a satisfactory massage effect for any of the various parts of his or her body.

This invention has been contrived in these circumstances, and an object of this invention is to provide a lounger-type air massager which enables a seated person to be seated at ease therein without an unnatural sense, and which can produce a great massage effect for the bag capacity, thus ensuring a high operating efficiency.

Another object of this invention is to provide a lounger-type air massager in which each inflatable bag can produce an appropriate pressing force for a corresponding part of the body of a seated person in response to the load applied from the body weight of the seated person to each of the bags, so that the seated person can obtain a satisfactory massage effect for any of the various parts of his or her body.

DISCLOSURE OF INVENTION

One lounger-type air massager according to this invention to achieve the former object, comprises: a lounger body including a seat portion and a backrest portion provided on a rear end of the seat portion; a bag provided at least in the seat portion out of the seat portion and the backrest portion to inflate and deflate when compressed air is fed into or discharged from the bag; and a compressed air control device for controlling the feed and discharge of the compressed air into and from the bag, a rear edge portion of the bag at the backrest side in the seat portion being fixed to the seat portion.

Since the bag in the seat portion is fixed at the rear edge portion thereof located on the backrest side, to the seat portion, the bag, as compared to the elongated bag in the seat portion of the aforementioned conventional lounger-type air massager in which the opposite ends of the bag are fixed to the seat portion, can decrease the number of a fixing portion to the seat portion, and can more easily be fixed to and removed from the seat portion.

When the compressed air is fed into the bag in the seat portion, the rear edge portion of the bag on the backrest side being fixed to the seat portion, the bag freely inflates diagonally backward and upward or toward the backrest portion with swinging around its fixed rear edge portion. Therefore, the bag moves a greater distance from the seat portion as it inflates, as compared to the bag in the seat portion of the aforementioned conventional lounger-type air massager in which the opposite ends of the bag are fixed to the seat portion. As the bag inflates in this manner, the buttocks or thighs of a person seated in the lounger-type air massager according to this invention are pressed diagonally backward and upward or toward the backrest portion, and the back of the person is pressed on the backrest portion and meets with resistance from the backrest portion. As a result of this, the upward movement of the seated person is restricted, so that a pressing force applied from the bag in the seat portion to the buttocks or thighs of the seated person can be efficiently transmitted to the buttocks or thighs of the seated person. This produces a great massage effect for the capacity of the bag, and heightens the operating efficiency of the aforesaid one lounger-type air massager according to this invention. Since the inflation of the bag diagonally presses the buttocks or thighs of the seated person backward and upward or toward the backrest portion, small projections can be deleted from the aforesaid one lounger-type air massager according to this invention while the small projections are essential to the aforementioned conventional lounger-type air massager. Accordingly, a person can seat at ease on the aforesaid one lounger-type air massager according to this invention without an unnatural sense.

Another lounger-type air massager according to this invention to achieve the former object, comprises: a lounger body including a seat portion and a backrest portion provided on a rear end of the seat portion; a bag provided at least in the backrest portion out of the seat portion and the backrest portion to inflate and deflate when compressed air is charged into or exhausted from the bag; and a compressed air control device for controlling the charging and exhaust of the compressed air into and from the bag, an upper end portion of the bag in the backrest portion being fixed to the backrest portion.

Since the upper end portion of the bag in the backrest portion is fixed to the backrest portion, the bag, as compared to the bag in the backrest portion of the aforementioned conventional lounger-type air massager in which the opposite ends of the bag are fixed to the backrest portion, can decrease the number of a fixing portion to the backrest portion, and can more easily be fixed to and removed from the backrest portion.

When the compressed air is fed into the bag in the backrest portion, the upper end portion of the bag being fixed to the backrest portion, the bag freely inflates diagonally forward and upward with swinging around its fixed upper end portion. Therefore, the bag moves a greater distance from the backrest portion as it inflates, as compared to the bag in the backrest portion of the aforementioned conventional lounger-type air massager in which the opposite ends of the bag are fixed to the backrest portion. As the bag inflates in this manner, the back of the person seated on the aforesaid another lounger-type air massager according to this invention is pressed diagonally forward and upward from the backrest portion and meets with resistance from the person's own body weight. As a result of this, the forward (i.e., in a direction from the rear end of the seat portion toward the front end thereof) movement and the upward movement of the seated person is restricted, so that a pressing force applied from the bag in the backrest portion to the back of the seated person can be efficiently transmitted to the back of the seated person. This produces a great massage effect for the capacity of the bag, and improves the operating efficiency of the aforesaid another lounger-type air massager according to this invention. Besides, the inflated bag in the backrest portion causes the back of the seated person to stretch upward, thereby further improving the massage effect.

Since the inflation of the bag diagonally upwardly presses the back of the seated person, small projections can be deleted from the aforesaid another lounger-type air massager according to this invention while the small projections in the backrest portion are essential to the aforementioned conventional lounger-type air massager. Accordingly, a person can seat at ease in the aforesaid another lounger-type air massager according to this invention without an unnatural sense.

Still another lounger-type air massager according to this invention to achieve the former object, comprises: a lounger body including a seat portion and a backrest portion provided on a rear end of the seat portion; bags provided in the seat portion and the backrest portion to inflate and deflate when compressed air is fed into or discharged from the bags; and a compressed air control device for controlling the feed and discharge of the compressed air into and from the bags, a rear edge portion of the bag at the backrest side in the seat portion being fixed to the seat portion, and an upper end portion of the bag in the backrest portion being fixed to the backrest portion.

Actions, functions, and effects created by the structures of the bags in the seat portion and the backrest portion described above are equivalent to actions, functions, and effects created by the structure of the bag in the seat portion in the aforesaid one lounger-type air massager according to this invention and actions, functions, and effects created by the structure of the bag in the backrest portion in the aforesaid another lounger-type air massager according to this invention.

In the aforesaid still another lounger-type air massager according to this invention, since the bag in the seat portion is fixed at its rear edge portion on the backrest side to the seat portion, and the bag in the backrest portion is fixed at its upper end portion to the backrest portion, each of those bags decreases the number of a fixing portion in the seat portion and the backrest portion, and can more easily be fixed to and removed from the seat portion and the backrest portion, as compared to the bag in the seat portion of the aforementioned conventional lounger-type air massager in which the opposite ends of the bag are fixed to the seat portion and to the bag in the backrest portion of the aforementioned conventional lounger-type air massager in which the opposite ends of the bag are fixed to the backrest portion.

In the aforesaid still another lounger-type air massager according to this invention, moreover, a pressing force applied from the bag in the seat portion to the buttocks or thighs of the seated person can be efficiently transmitted to the buttocks or thighs of the seated person, and at the same time, a pressing force applied from the bag in the backrest portion to the back of the seated person can be efficiently transmitted to the back of the seated person when these bags in the seat portion and the backrest portion are charged with the compressed air. This produces great massage effect for the capacity of each of the bag in the seat portion and the bag in the backrest portion, and heightens the operating efficiency of the aforesaid still another lounger-type air massager according to this invention. Since the inflation of the bag in the seat portion presses the buttocks or thighs of the seated person diagonally backward and upward or toward the backrest portion, small projections can be deleted from the seat portion in the aforesaid still another lounger-type air massager of this invention while the small projections are essential to the aforementioned conventional lounger-type air massager. Further, since the inflation of the bag in the backrest portion presses the back of the seated person diagonally upward, small projections can be deleted from the backrest portion in the aforesaid still another lounger-type air massager of this invention while the small projections are essential to the aforementioned conventional lounger-type air massager. Accordingly, a person can seat at ease on the aforesaid still another lounger-type air massager according to this invention without an unnatural sense.

One lounger-type air massager according to this invention to achieve the latter object, comprises: a lounger body including a seat portion and a backrest portion provided on a rear end of the seat portion; bags provided in the seat portion and the backrest portion to inflate and deflate when compressed air is fed into or discharged from the bags; and a compressed air control device for controlling the feed and discharge of the compressed air into and from the bags, the compressed air control device setting the same exhaust time for each of the bags and setting a longer charging time for the bag among the aforesaid bags, which is subjected to a heavier load from the body weight of a person seated on the lounger body than the other bags, than the charging time for the other bag.

In this air massager, since the compressed air control device sets the same exhaust time for each of the bags in the seat portion and the backrest portion when the bags are exhausted. Thus, when the same exhaust time is up, the quantity of compressed air remaining in the bag which is subjected to a relatively heavy load from the body weight of the seated person and is exhausted at high speed, is smaller than the quantity of compressed air remaining in the other bag that is subjected to a relatively light load from the body weight of the seated person.

When the bags in the seat portion and the backrest portion are charged with compressed air, the compressed air control device sets the longer charging time for the bag which is subjected to a relatively heavy load from the body weight of the seated person, than the charging time for the other bag that is subjected to a lighter load from the body weight of the seated person on the lounger body than the aforesaid bag, so that greater quantity of compressed air can be fed into the bag that is subjected to a relatively heavy load from the body weight of the seated person than the other bag. Accordingly, even the bag which is subjected to a relatively heavy load from the body weight of the seated person, can inflate to substantially the same extent as the other bag when the charging time is up, so that the bags inflated fully have substantially the same hardness as to each other and various parts of the body of the seated person corresponding to the bags can be pressed with the same strength as to each other. Thus, appropriate pressing forces for the various parts of the body of the seated person can be obtained from a large number of inflatable bags that correspond to the various parts, in response to the load applied to the bags from the body weight of the seated person, so that the seated person can obtain a satisfactory massage effect for all of the various parts of his or her body.

Another lounger-type air massager according to this invention to achieve the latter object, comprises: a lounger body including a seat portion and a backrest portion provided on the rear end of the seat portion; bags provided in the seat portion and the backrest portion to inflate and deflate when compressed air is fed into or discharged from the bags; and a compressed air control device for controlling the feed and discharge of the compressed air into and from the bags, the compressed air control device setting the same charging time and the same exhaust time for each of the bags, and the capacity of the bag among the aforesaid bags, which is subjected to a heavier load from the body weight of a person seated on the lounger body than the other bag is set smaller than the capacity of the other bag.

Since the same charging time is set for each of the bags and the capacity of the bag among the bags, which is subjected to a heavier load from the body weight of the person seated on the lounger body than the other bag is set smaller than the capacity of the other bag, the bag which is subjected to a heavier load from the body weight of the seated person than the other bag can inflate to substantially the same extent as the other bag when the charging of compassed air into the bags is completed, so that the bags inflated fully, have substantially the same hardness as to each other and various parts of the body of the seated person corresponding to the bags can be pressed with the same strength as to each other. Thus, appropriate pressing forces for the various parts of the body of the seated person can be obtained from a large number of inflatable bags that correspond to these various parts, in response to the load applied to the bags from the body weight of the seated person, so that the seated person can obtain a satisfactory massage effect for all of the various parts of his or her body.

Still another lounger-type air massager according to this invention to achieve the latter object, comprises: a lounger body including a seat portion and a backrest portion provided on the rear end of the seat portion; bags provided in the seat portion and the backrest portion to inflate and deflate when compressed air is fed into or discharged from the bags; and a compressed air control device for controlling the feed and discharge of the compressed air into and from the bags, the compressed air control device setting the same charging time and the same exhaust time for each of the bags, and charging/exhaust resistance of the bag among the aforesaid bags, which is subjected to a heavier load from the body weight of a person seated on the lounger body than the other bag is set lower than the charging/exhaust resistance of the other bag.

When the compressed air is fed into these bags, greater quantity of compressed air can be fed into the bag among the aforesaid bags, which is subjected to a heavier load from the body weight of the person seated on the lounger body than the other bag, while the same charging time is set for the bags, because the charging/exhaust resistance of the bag among the bags, which is subjected to a heavier load from the body weight of a person seated on the lounger body than the other bag, is set lower than the changing/exhaust resistance of the other bag.

Accordingly, the bag which is subjected to a relatively heavy load from the body weight of the seated person can inflate to substantially the same extent as the other bag when the charging of compressed air into the bags is completed, so that the bags inflated fully, have substantially the same hardness as to each other and various parts of the body of the seated person corresponding to the bags can be pressed with the same strength as to each other. Thus, appropriate pressing forces for the various parts of the body of the seated person can be obtained from a large number of inflatable bags that correspond to these various parts, in response to the load applied to the bags from the body weight of the seated person, so that the seated person can obtain a satisfactory massage effect for all of the various parts of his or her body.

Setting of the desired charging/exhaust resistance can be realized, for example, by changing a diameter of a charging/exhaust port which is formed in each of the bags for charging and exhaust of compressed air, or by changing a diameter or a length of a charging/exhaust pipe which is connected to each of the bags for charging and exhaust of compressed air, or by fitting charging/exhaust resisting member into the charging/exhaust port or pipe.

A further lounger-type air massager according to this invention to achieve the latter object, comprises: a lounger body including a seat portion and a backrest portion provided on the rear end of the seat portion; bags provided in the seat portion and the backrest portion to inflate and deflate when compressed air is fed into or discharged from the bags; and a compressed air control device for controlling the feed and discharge of the compressed air into and from the bags, the compressed air control device setting the same charging time for each of the bags and setting the exhaust time for the bag among the bags, which is subjected to a heavier load from the body weight of a person seated on the lounger body than the other bag, is set shorter than the exhaust time for the other bag.

When the compressed air is discharged from these bags, the quantity of compressed air remaining in the bag which is subjected to a heavier load from the body weight of the person seated on the lounger body than the other bag is prevented from becoming smaller than the quantity of compressed air remaining in the other bag, whereby the quantity of compressed air remaining in the bag that is subjected to a heavier load from the body weight of the seated person and the quantity of compressed air remaining in the other bag are made substantially equal.

When the compressed air is fed into these bags, the compressed air control device sets the same charging time for each of the bags, so that the bag which is subjected to a heavier load from the body weight of the seated person than the other bag can inflate to substantially the same extent as the other bag when the charging of compressed air is completed to make the bags inflated fully have substantially the same hardness as to each other and various parts of the body of the seated person can be pressed with the same strength as to each other. Thus, appropriate pressing forces for the various parts of the body of the seated person can be obtained from a large number of inflatable bags that correspond to these various parts, in response to the load applied to the bags from the body weight of the seated person, so that the seated person can obtain a satisfactory massage effect for all of the various parts of his or her body.

In each of the aforementioned various lounger-type air massagers according to this invention to achieve the latter object, the bag among the aforesaid bags, which is subjected to a heavier load from the body weight of the person seated on the lounger body than the other bag, is located in the seat portion, further the bag among the aforesaid bags, which is subjected to a greater load from the body weight of the person seated on the lounger body than the other bag, may be located along the line of the backbone of the seated person in the backrest portion.

BEST MODE OF CARRYING OUT THE INVENTION

Various embodiments of a lounger-type air massager of the present invention will now be described in detail with reference to the accompanying drawings.

Referring first to FIGS. 1 to 7C, a lounger-type air massager according to a first embodiment of the present invention will be described.

Figure 1:
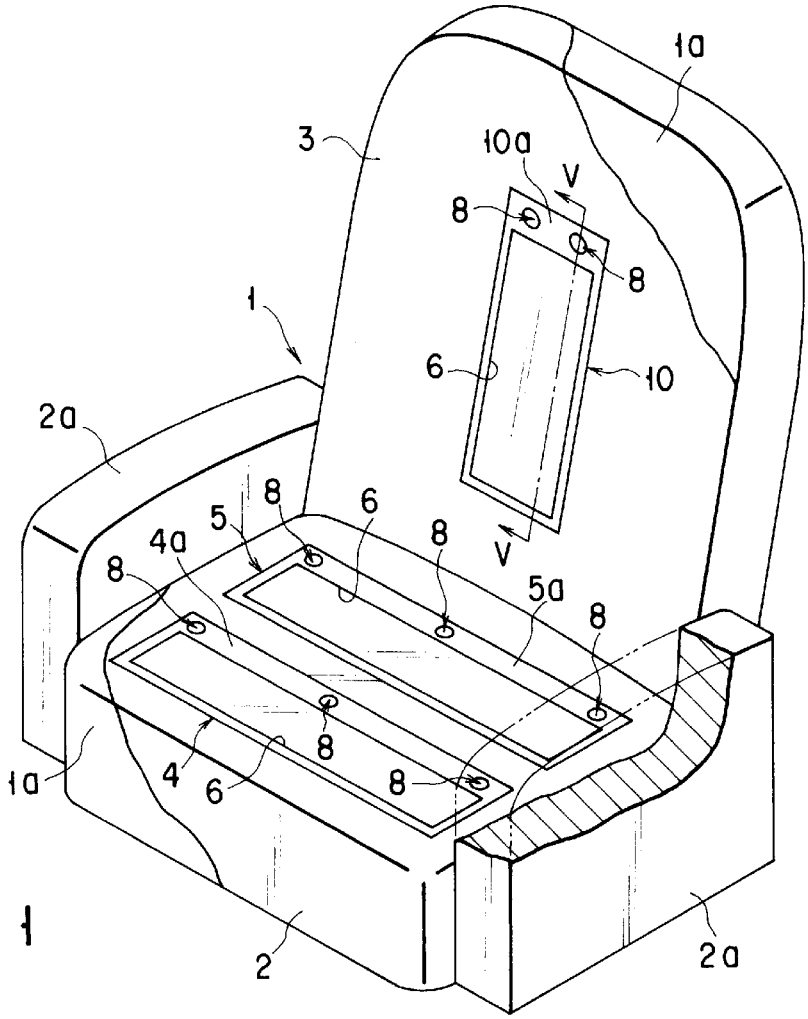
FIG. 1 is a perspective view showing the whole structure of a lounger-type air massager according to a first embodiment of the present invention, with a portion thereof being cut away.
Figure 2:
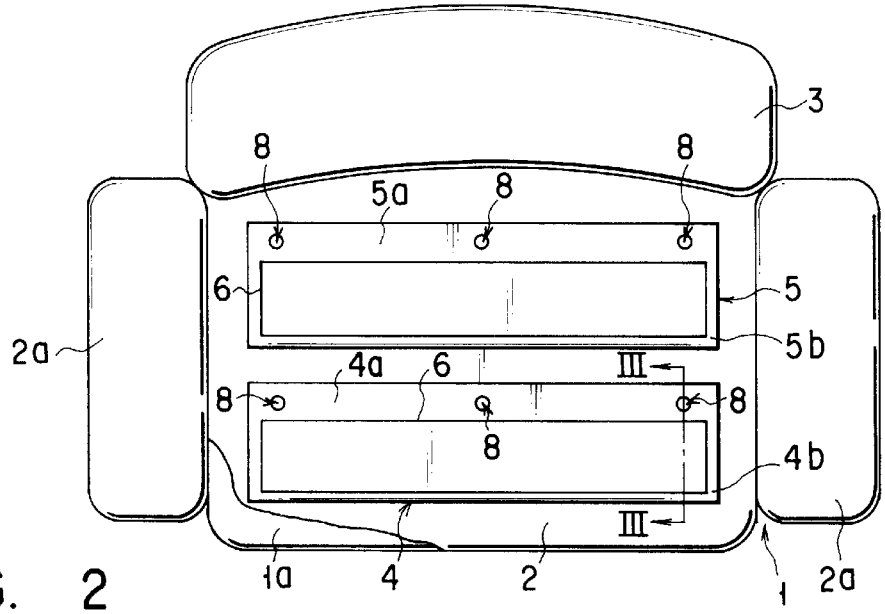
FIG. 2 is a plan view showing the lounger-type air massager of FIG. 1, with a portion thereof being cut away.

FIG. 1 shows a whole structure of the lounger-type air massager according to the first embodiment of the present invention, with a portion thereof being cut away, and FIG. 2 is a plan view showing the lounger-type air massager of FIG. 1, with a portion thereof being cut away.

A lounger body 1 of the lounger-type air massager according to the first embodiment includes a seat portion 2, a backrest portion 3 provided in the rear end of the seat portion 2 to incline at a predetermined angle thereto, and a pair of armrest portions 2*a* arranged on the opposite sides of the seat portion 2 in the width direction thereof. The armrest portions 2*a* may be omitted, and the backrest portion 3 may be designed so as to be reclinable.

A first seat bag 4 for massaging the thighs of the body of a person seated on the seat portion 2 is disposed in the vicinity of the front end of the upper surface of the seat portion 2. The first seat bag 4 extends along the front edge of the upper surface of the seat portion 2 to substantially cover the whole of the width of the seat portion 2. A second seat bag 5 for massaging the buttocks of the body of the person seated on the seat portion 2 is disposed in the vicinity of the rear end of the upper surface of the seat portion 2. The second seat bag 5 extends substantially parallel to the first seat bag 4 to substantially cover the whole of the width of the seat portion 2.

Figure 4:
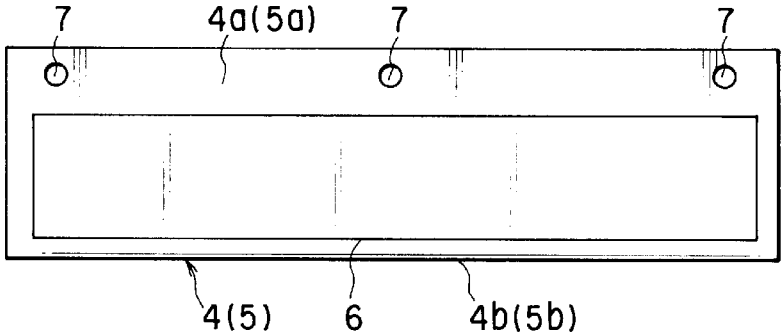
FIG. 4 is a plan view showing only the inflatable bag fixed to the seat portion of the lounger body of the lounger-type air massager of FIG. 1.

FIG. 4 is a plan view of the first seat bag 4. Since the second seat bag 5 is structured in the same manner as the first seat bag 4, reference numerals for the second seat bag 5 are also shown with they being parenthesized in FIG. 4.

As shown in FIG. 4, each of the first and second seat bags 4 and 5 is formed as a transversely elongated flat bag by folding a square airtight soft material in two and then heat-sealing its peripheral edge portions. Reference numeral 6 designates the outline (i.e., heat-sealing line) of the internal space of each of the first and second seat bags 4 and 5. One of the two opposite end edge portions of each of the first and second seat bags 4 and 5 that extend in the longitudinal direction thereof (right and left directions in FIG. 4) is wider than the other, and is formed with fixing holes 7. The wider, longitudinally extending one end edge portion constitutes a fixing portion 4*a* or 5*a*, while the narrower, longitudinally extending other end edge portion constitutes a free end portion 4*b* or 5*b*.

The internal space of each of the first and second seat bags 4 and 5 has a charging/exhaust port (not shown). As compressed air is fed into or discharged from the aforesaid internal space through the charging/exhaust port, each of the first and second seat bags 4 and 5 inflates or deflates.

As shown in FIG. 1, the first and second seat bags 4 and 5 are fixed individually to the aforesaid predetermined positions on the seat portion 2 by means of fixtures 8 inserted in the fixing holes 7 with the fixing portions 4*a* and 5*a* being located on the rear end side (i.e., backrest side) of the seat portions 2.

Figure 3:
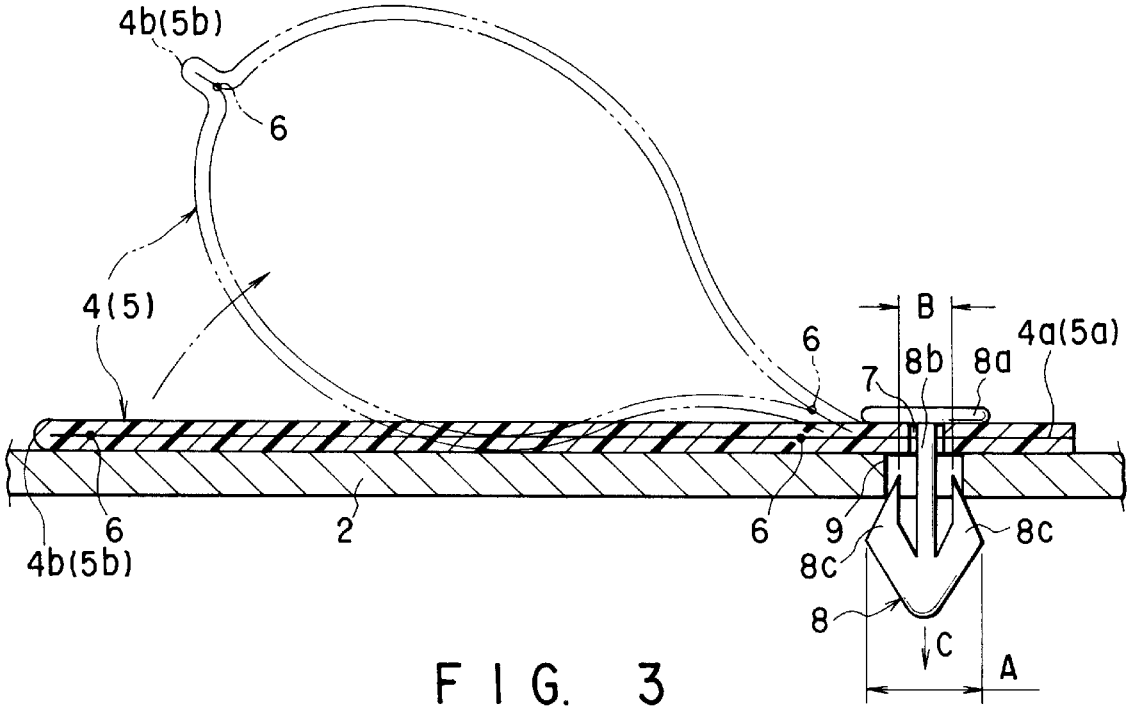
FIG. 3 is a ectional view taken along line III—III of FIG. 2, showing a deflated state and an inflated state of an inflatable bag fixed to a seat portion of a lounger body of the lounger-type air massager of FIG. 1.

In FIG. 3, a cross section of the first seat bag 4 fixed to the predetermined position on the seat portion 2 of the lounger body 1 of the lounger-type air massager of FIG. 1 is drawn by a solid line, the first seat bag 4 is in a deflated state, and this cross section is taken along line III—III of FIG. 2. Also in FIG. 3, reference numerals for the second seat bag 5 which is structured in the same manner as the first seat bag 4, are shown with they being parenthesized. Further, FIG. 3 shows structures for fixing the fixing portions 4*a* and 5*a* of the first and second seat bags 4 and 5 to the aforesaid predetermined positions on the seat portion 2, in detail.

More specifically, engaging holes 9 each of which has a diameter larger than that of each of the fixing holes 7 of the fixing portions 4*a* and 5*a* of the first and second seat bags 4 and 5, are formed in the aforesaid predetermined positions in the seat portions 2 to face the fixing holes 7. Each fixture 8 comprises a disk-shaped head 8*a*, a shaft 8*b* protruding from the center of one side of the head 8*a*, and a pair of engaging pieces 8*c* spread out in the diametrical direction of the shaft 8*b* from the projecting end of the shaft 8*b*. The head 8*a*, the shaft 8*b*, and the pair of engaging pieces 8*c* are formed integrally with each other of a synthetic resin. The pair of engaging pieces 8*c* gradually spread out from the projecting end of the shaft 8*b* toward the head 8*a*, and are then bent so as to shorten the distance between them gradually. The diameter of the head 8*a* is larger than that of each of the fixing holes 7 of the fixing portions 4*a* and 5*a* of the first and second seat bags 4 and 5, the diameter of the shaft 8*b* is smaller than that of each of the fixing holes 7, a maximum width A of the pair of engaging pieces 8*c* is larger than the diameter of each of the engaging holes 9 in the seat portion 2, and a distance B between the extending ends of the pair of engaging pieces 8*c* is shorter than the diameter of each of the engaging holes 9.

In order to fix the first and second seat bags 4 and 5 to the aforesaid predetermined positions on the seat portion 2, at first the fixing holes 7 of the fixing portions 4*a* and 5*a* of the first and second seat bags 4 and 5 are opposed to their corresponding engaging holes 9 at the aforesaid predetermined positions on the seat portion 2, and then the fixtures 8 are moved downward from positions above the first and second seat bags 4 and 5 with the paired engaging pieces 8*c* being orientated downward to be inserted into the fixing holes 7 of the fixing portions 4*a* and 5*a* of the first and second seat bags 4 and 5 and the engaging holes 9 of the seat portion 2. The paired engaging pieces 8*c* are elastically deformed as they pass through each of the fixing holes 7 and each of the engaging holes 9, and are restored to their original shape, as shown in FIG. 3, after passing through each of the fixing holes 7 and each of the engaging holes 9.

As a result of this, the extending ends of paired engaging pieces 8*c* engage with the inner edge of each engaging holes 9, as shown in FIG. 3. Thereafter, the extending ends of paired engaging pieces 8*c* tend to spread further outward by their own elastic force, so that each fixture 8 is subjected to a downward force, as indicated by arrow C in FIG. 3. Under this downward force, each of the fixing portions 4*a* and 5*a* of the first and second seat bags 4 and 5 is pinched by the heads 8*a* of the fixtures 8 and the upper surface of the seat portion 2 to be fixed on the upper surface of the seat portion 2.

The fixture 8 can be easily drawn out of the seat portion 2 by head 8*a* being strongly pulled upward. Thus, if the first and second seat bags 4 and 5 easily fixed to the aforesaid predetermined positions on the seat portion 2 by the fixtures 8 in the aforesaid manner, must be replaced with new ones because these bags 4 and 5 are broken for example, replacement operation is easy.

Each of the first and second seat bags 4 and 5 in which only the fixing portions 4*a* and 5*a* located on the rear end side (i.e., backrest side) of the seat portion 2 are fixed to the predetermined positions on the upper surface of the seat portion 2, as compared to the elongated bags in the seat portion of the aforementioned conventional lounger-type air massager in which the opposite ends of each bag located in the width direction of the seat portion 2 are fixed to the seat portion, can decrease the number of a fixing portion on the seat portion 2, so that the first and second seat bags 4 and 5 can more easily be fixed to the aforesaid predetermined positions and removed from the aforesaid predetermined positions.

As shown in FIG. 1, a backrest bag 10 for massaging the back (muscles along the backbone, in particular) of the body of the person seated on the seat portion 2 is located at a predetermined position substantially on the center of the front surface of the backrest portion 3 of the lounger body 1 of the lounger-type air massager. The backrest bag 10 extends in the vertical direction along the front surface of the backrest portion 3.

Figure 5:
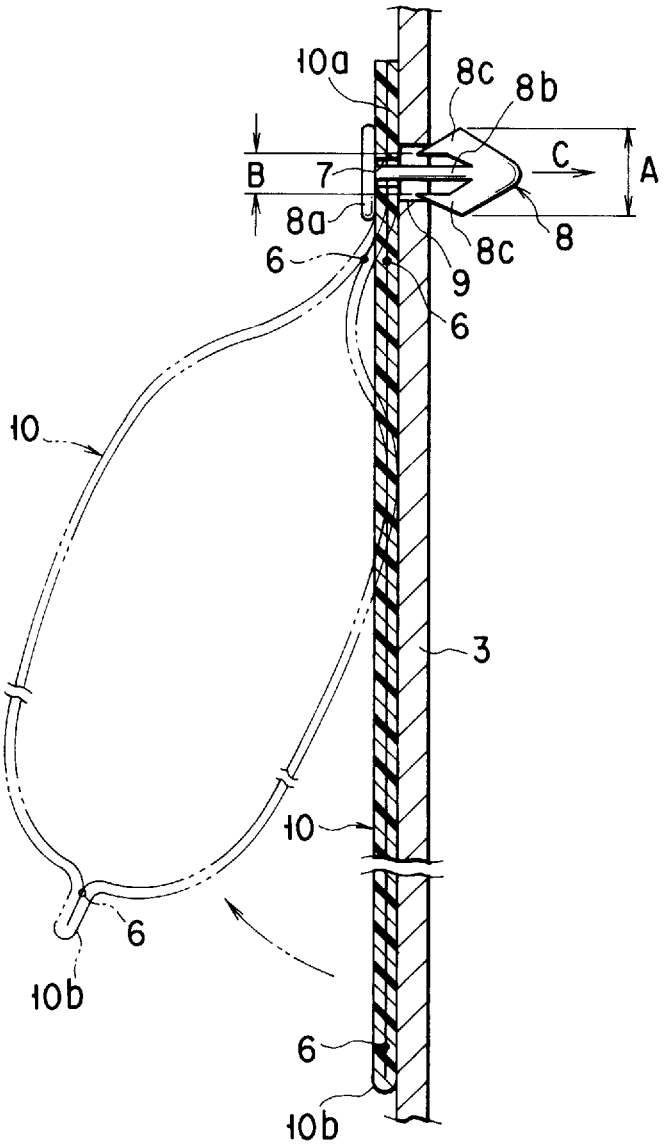
FIG. 5 is a sectional view taken along line V—V of FIG. 1, showing a deflated state and an inflated state of an inflatable bag fixed to a backrest portion of the lounger body of the lounger-type air massager of FIG. 1.

In FIG. 5, the deflated backrest bag 10 fixed to the predetermined position substantially on the center of the front surface of the backrest portion 3 of the lounger body 1 of the lounger-type air massager of FIG. 1, is drawn by a solid line, and this cross section is taken along line V—V of FIG. 1. Further, FIG. 6 shows a front view of the backrest bag 10.

The structure of the backrest bag 10 and the structure for fixing the backrest bag 10 to the predetermined position on the backrest portion 3 are the same as the structure of each of the aforesaid first and second seat bags 4 and 5 and the structure for fixing each of the bags 4 and 5 to their corresponding predetermined positions on the seat portion 2. In FIGS. 1, 5 and 6 those of which show the structures associated with the backrest bag 10, therefore, components and portions identical with or equivalent to the components and portions shown in FIGS. 1, 3 and 4 those of which show the structures associated with the first and second seat bags 4 and 5, are designated by the same reference numerals that are used to designate the corresponding components and portions in FIGS. 1, 3 and 4, and detailed descriptions of those components and portions are omitted. Referring now to FIGS. 1, 5 and 6, only those structures which are different from the structures in FIGS. 1, 3 and 4 associated with the first and second seat bags 4 and 5 will be described.

Figure 6:
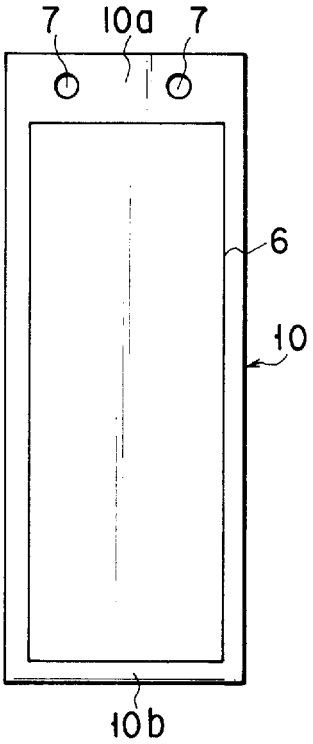
FIG. 6 is a front view showing only the inflatable bag fixed to the backrest portion of the lounger body of the lounger-type air massager of FIG. 1.

As shown in FIG. 6, the backrest bag 10 is a vertically elongated flat bag that is formed by folding a square airtight soft material in two and then heat-sealing its peripheral edge portions. One of the two opposite end edge portions of the backrest bag 10 that extend in the width direction (horizontal direction in FIG. 6) thereof is greater than the other in the dimension in the longitudinal direction of the backrest bag 10, and is formed with fixing holes 7. The longer, transversely extending one end edge portion constitutes a fixing portion 10*a*, while the shorter, transversely extending other end edge portion constitutes a free end portion 10*b*.

The internal space of the backrest bag 10 has a charging/exhaust port (not shown). As compressed air is fed into or discharged from the aforesaid internal space through the charging/exhaust port, the backrest bag 10 inflates or deflates.

The backrest bag 10 is fixed by means of fixtures 8 to the aforesaid predetermined position on the front surface of the backrest portion 3 with the fixing portion 10*a* being located upward. The operations for fixing the backrest bag 10 to the aforesaid predetermined position on the front surface of the backrest portion 3 by means of the fixtures 8 and the operation for removing the backrest bag 10 from the aforesaid predetermined position are as easy as the operation for fixing the first and second seat bags 4 and 5 to the aforesaid predetermined positions on the upper surface of the seat portion 2 by means of the fixtures 8 and the operation for removing the first and second seat bags 4 and 5 from the aforesaid predetermined positions.

The backrest bag 10 in which only the fixing portion 10*a* located on the upper end side of the backrest portion 3 is fixed to the predetermined position on the front surface of the backrest portion 3, as compared to the backrest bag of the aforementioned conventional lounger-type air massager in which the opposite ends located in the width direction of the backrest portion are fixed to the backrest portion, can decrease the number of a fixing portion on the backrest portion 3, and can more easily be fixed to the aforesaid predetermined position and removed from the aforesaid predetermined position.

After the first and second seat bags 4 and 5 and backrest bag 10 are fixed to the aforesaid predetermined positions on the upper surface of the seat portion 2 and to the aforesaid predetermined position on the front surface of the backrest portion 3, as mentioned before, at least the aforesaid upper and front surfaces of the lounger body 1 are covered with a soft cover 1*a*.

Figure 7A:
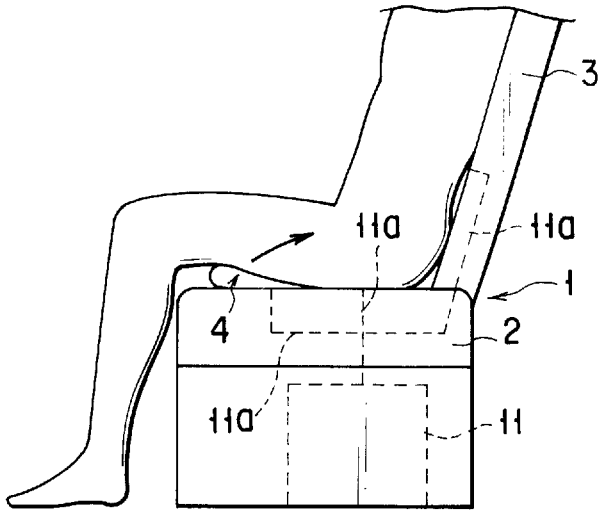
FIG. 7A is a side view schematically showing a state in which a bag fixed to the seat portion of the lounger body of the lounger-type air massager of FIG. 1 to correspond to the thighs of a seated person, is inflated to press the thighs.
Figure 7B:
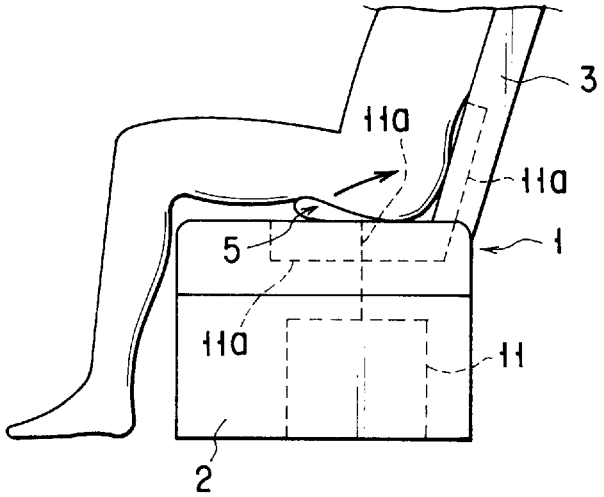
FIG. 7B is a side view schematically showing a state in which a bag fixed to the seat portion of the lounger body of the lounger-type air massager of FIG. 1 to correspond to the buttocks of the seated person, is inflated to press the buttocks.
Figure 7C:
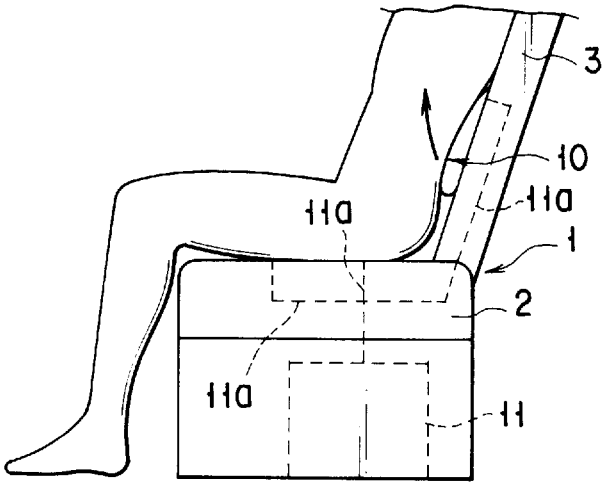
FIG. 7C is a side view schematically showing a state in which a bag fixed to the backrest portion of the lounger body of the lounger-type air massager of FIG. 1 is inflated to press the back of the seated person.

As shown in FIGS. 7A to 7C, in the seat portion 2 a compressed air control device 11 is contained for controlling the feed and discharge of the compressed air into and from the first and second seat bags 4 and 5 and backrest bag 10. The compressed air control device 11 includes charging/exhaust pipes 11*a* that are connected to the charging/exhaust ports (not shown) of the first and second seat bags 4 and 5 and backrest bag 10. The charging/exhaust pipes 11*a* must be arranged so as not to hinder the free inflation and deflation of the first and second seat bags 4 and 5 and backrest bag 10 when the compressed air is fed therein and discharged therefrom, and at least the portions of the charging/exhaust pipes 11*a* near the charging/exhaust ports (not shown) of the first and second seat bags 4 and 5 and backrest bag 10 should preferably be flexible. The compressed air control device 11 further comprises an air compressor, a filter tank, a distribution switch, and a controller for those components, none of which are shown.

The filter tank is connected to a compressed air discharge port of the aforesaid air compressor used as a compressed air source and absorbs the pulsation of the compressed air to smooth a compressed air current, while the aforesaid distribution switch used as an air distributing means is connected to the outlet of the filter tank.

The distribution switch is a well-known rotary valve that is used in the conventional lounger-type air massager of this type and is actuated by means of a motor or the like, and the rotary valve has one intake port connected to the outlet of the filter tank, a plurality of distribution ports connected with the charging/exhaust pipes 11*a* that are connected to the first and second seat bags 4 and 5 and backrest bag 10, and one exhaust port. By rotating a flow changing rotor, at least one of the distribution ports is selectively connected to the intake port, and at least one of the unselected distribution ports is connected to the exhaust port. This causes the compressed air to be selectively fed into or discharged from the first and second seat bags 4 and 5 and backrest bag 10.

The controller (not shown) is a well-known microcomputer that comprises a CPU (central processing unit), ROM (read-only memory), RAM (random access memory), etc. This controller is loaded with programs for executing various operation modes. When any one of the various operation modes is selected by using a control panel (not shown) provided on one of the armrest portions 2*a* or a remote operation device (not shown), the controller (not shown) controls the operations of the air compressor, distribution switch, etc. in accordance with the selected operation mode, and causes the compressed air to be selectively fed into or discharged from the first and second seat bags 4 and 5 and backrest bag 10 in accordance with the selected operation mode. Thus, the lounger-type air massager according to this embodiment can massage the body of the seated person by using the first and second seat bags 4 and 5 and backrest bag 10 in accordance with the selected operation mode.

At this time, the inflated first and second seat bags 4 and 5 and backrest bag 10 press their corresponding portions (i.e., thighs, buttocks, and back) of the body of the seated person, as shown in FIGS. 7A, 7B and 7C. In an exhaust process, the compressed air is rapidly discharged from each of the first and second seat bags 4 and 5 and backrest bag 10 by the weight of the body of the seated person, so that each of the first and second seat bags 4 and 5 and backrest bag 10 deflates rapidly.

In FIG. 3, a cross section of the inflated first or second seat bag 4 or 5 fixed to the predetermined position on the seat portion 2 of the lounger body 1 of the lounger-type air massager of FIG. 1, is drawn by a two-dot chain line. As seen from this drawing, since only the fixing portion 4*a* or 5*a* of each of the inflated first and second seat bags 4 and 5, which is located on the rear end side (i.e., backrest side) of the seat portion 2 at the predetermined position on the upper surface of the seat portion 2, is fixed at the predetermined position on the upper surface of the seat portion 2, so that the free end portion 4*b* or 5*b* is freely diagonally raised upward and backward or toward the backrest portion 3, and swing around the fixing portion 4*a* or 5*a*, as indicated by an arrow of a two-dot chain line. Thus, each of the first and second seat bags 4 and 5 of the lounger-type air massager 1 according to the foregoing first embodiment, as compared to the bag in the seat portion of the aforementioned conventional lounger-type air massager in which the opposite ends are fixed to the seat portion, moves a great distance for its capacity from the upper surface of the seat portion 2 as it inflates.

As the first and second seat bags 4 and 5 inflate in this manner, the buttocks and thighs of the person seated on the lounger-type air massager 1 according to the foregoing first embodiment are pressed diagonally backward and upward or toward the backrest portion 3, as shown in FIGS. 7A and 7B, and the back of the seated person is pressed by the backrest portion 3 and meets with resistance from the backrest portion 3. As a result of this, the upward movement of the seated person is restricted, so that pressing forces from the first and second seat bags 4 and 5 to be applied to the buttocks and thighs of the seated person can be efficiently transmitted to the buttocks and thighs of the seated person. This produces a great massage effect for the capacity of each of the bags, and heightens the operating efficiency of the lounger-type air massager according to the foregoing first embodiment. Since the inflation of the bags on the seat portion 2 causes the buttocks and thighs of the seated person to be diagonally pressed backward and upward or toward the backrest portion 3, the lounger-type air massager 1 according to the foregoing first embodiment can delete small projections from the seat portion while the small projections are essential to the aforementioned conventional lounger-type air massager. Accordingly, a person can seat at ease on the lounger-type air massager according to the foregoing first embodiment without an unnatural sense.

In FIG. 5, a cross section of the inflated backrest bag 10 fixed to the predetermined position on the backrest portion 3 of the lounger body 1 of the lounger-type air massager of FIG. 1 is drawn by a two-dot chain line. As seen from this drawing, since only the fixing portion 10*a* of the inflated backrest bag 10 which is located on the upper end side of the backrest portion 3 at the predetermined position on the front surface of the backrest portion 3, is fixed to the aforesaid predetermined position, so that the free end portion 10*b* is freely diagonally raised upward and forward and swings around the fixing portion 10*a*, as indicated by an arrow of a two-dot chain line. Thus, the backrest bag 10 of the lounger-type air massager according to the foregoing first embodiment, as compared to the bag on the backrest portion of the aforementioned conventional lounger-type air massager in which the opposite ends of the bag are fixed to the backrest portion, moves a great distance for its capacity from the front surface of the backrest portion 3 as it inflates.

As the backrest bag 10 inflates in this manner, the back of the person seated on the lounger-type air massager according to the foregoing first embodiment is pressed diagonally forward and upward from the backrest portion 3, as shown in FIG. 7C, and meets with resistance from the person's own body weight. As a result of this, upward and forward (i.e., in the direction from the rear end of the seat portion 2 toward the front end) movement of the seated person are restricted, so that a pressing force from the backrest bag 10 to be applied to the back of the seated person can be efficiently transmitted to the back of the seated person. This produces a great massage effect for the capacity of the backrest bag 10, and heightens the operating efficiency of the lounger-type air massager according to the foregoing first embodiment. Since the inflated backrest bag 10 causes the back (muscles along the backbone, in particular) of the seated person to extend upward, it can also stretch the back (muscles along the backbone). Since the inflation of the bag causes the back of the seated person to be diagonally pressed upward, small projections can be deleted from the backrest portion of the lounger-type air massager according to the foregoing first embodiment while the small projections are essential to the aforementioned conventional lounger-type air massager. Accordingly, a person can seat at ease on the lounger-type air massager according to the foregoing first embodiment without an unnatural sense.

Figure 8:
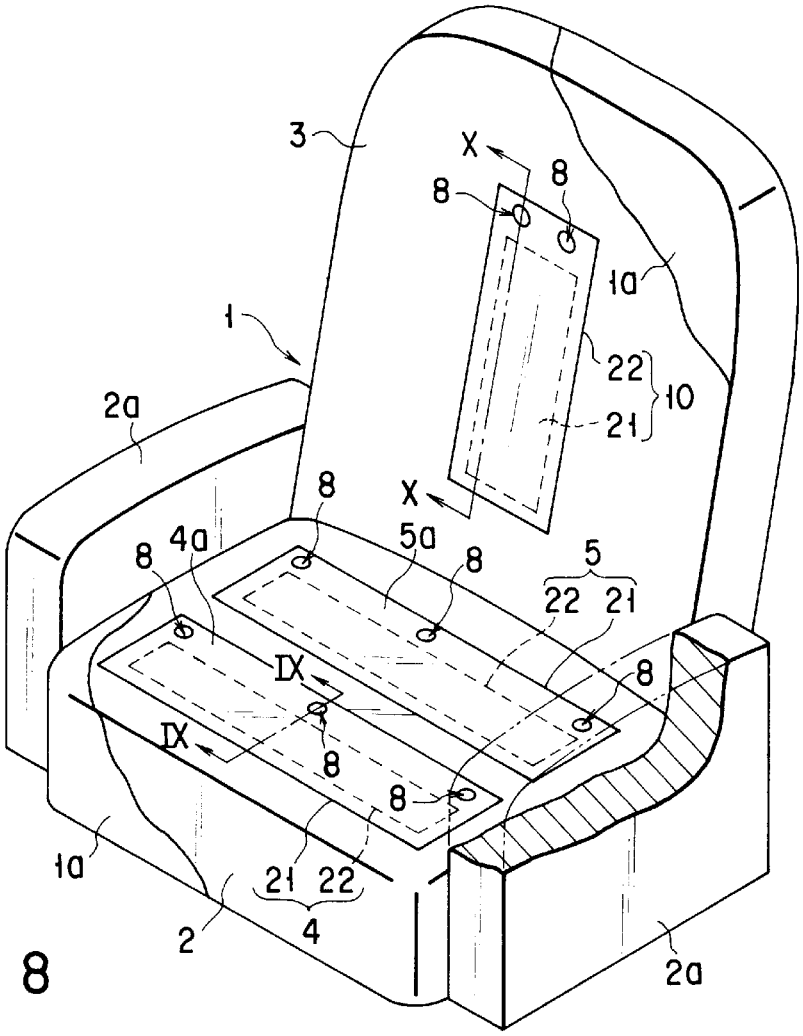
FIG. 8 is a perspective view showing the whole structure of a lounger-type air massager according to a second embodiment of the present invention, with a portion thereof being cut away.
Figure 9:
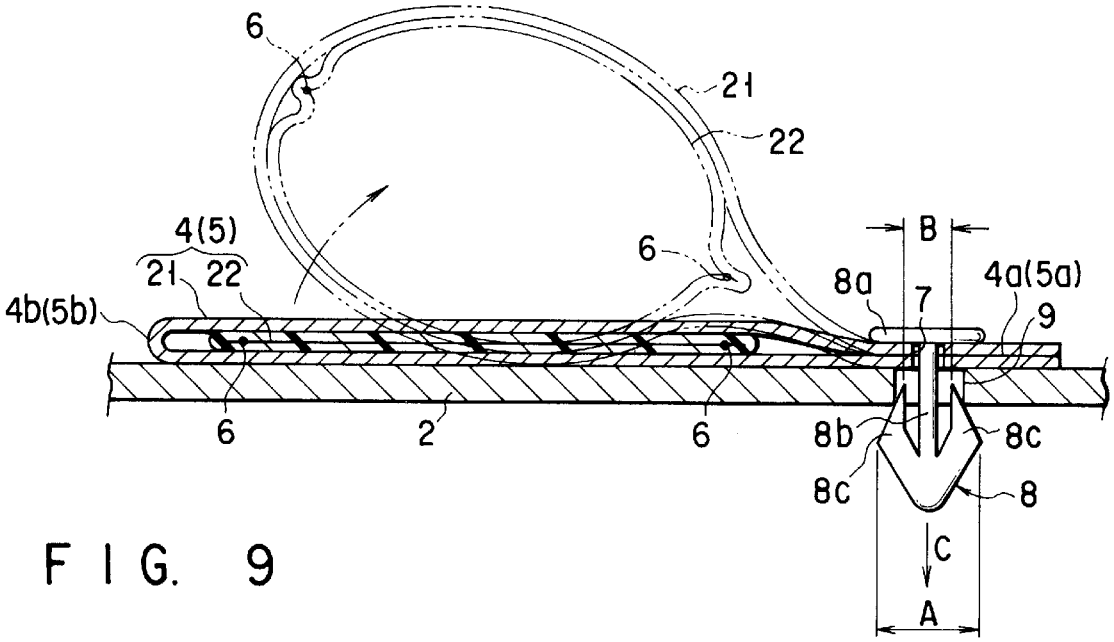
FIG. 9 is a sectional view taken along line IX—IX of FIG. 8, showing a deflated state and an inflated state of an inflatable bag fixed to a seat portion of a lounger body of the lounger-type air massager of FIG. 8 to correspond to the thighs of a seated person.
Figure 10:
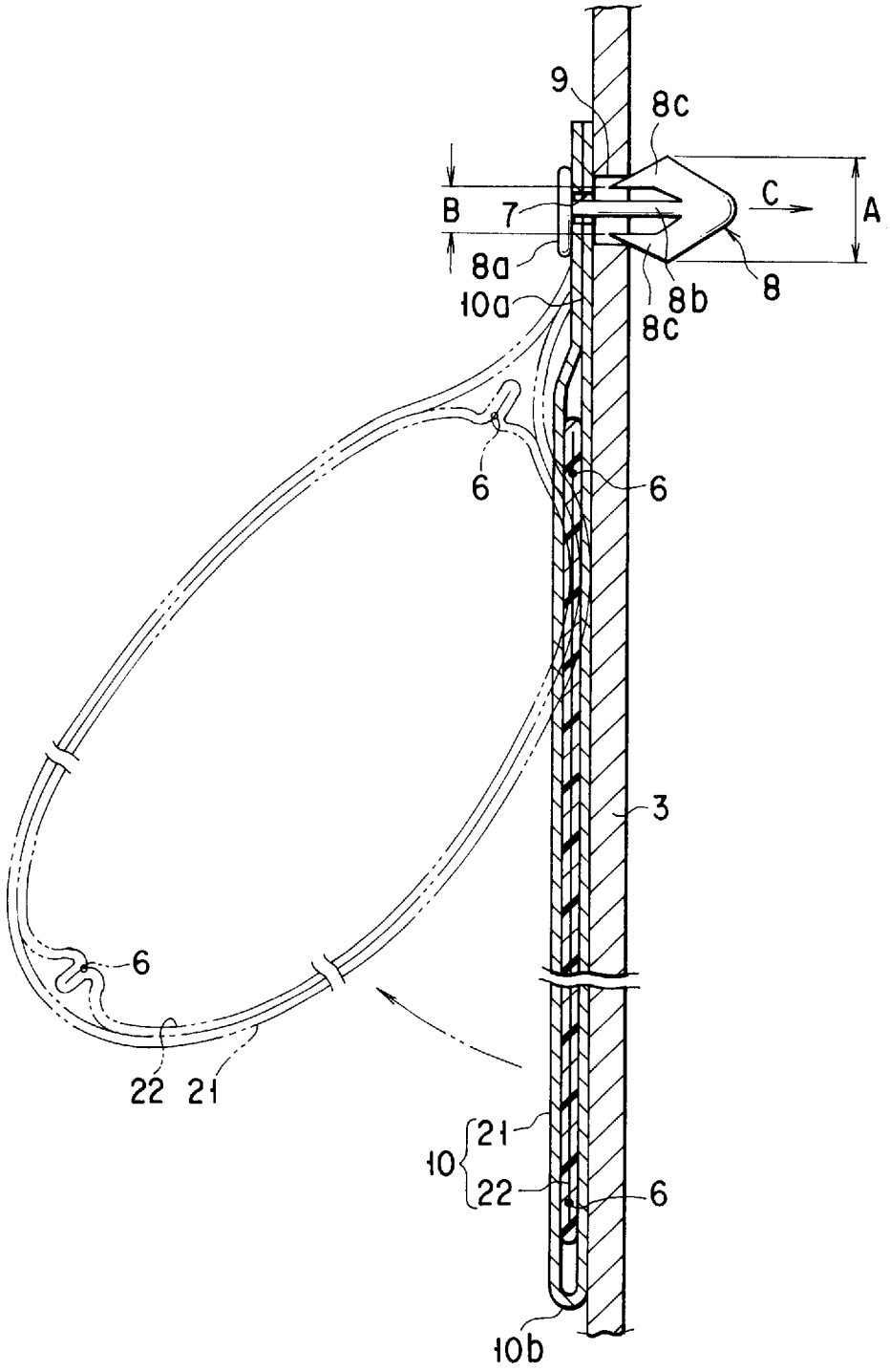
FIG. 10 is a sectional view taken along line X—X of FIG. 8, showing a deflated state and an inflated state of an inflatable bag fixed to a backrest portion of the lounger body of the lounger-type air massager of FIG. 8 to correspond to the back of the seated person.

Referring now to FIGS. 8 to 10, a lounger-type air massager according to a second embodiment of the present invention will be described.

Since a main part of the structure of the lounger-type air massager according to the second embodiment is the same as a main part of the structure of the lounger-type air massager according to the first embodiment of the present invention described before with reference to FIGS. 1 to 7, those components of the lounger-type air massager according to the second embodiment which are identical with or equivalent to the components of the lounger-type air massager according to the first embodiment, are designated by the same reference numerals that are used to designate the corresponding components in the lounger-type air massager according to the first embodiment, and detailed descriptions of those components are omitted.

In the lounger-type air massager according to the second embodiment, structures of first and second seat bags 4 and 5 and backrest bag 10 are different from those of the lounger-type air massager according to the first embodiment. As is well shown in FIG. 3 or 5, each of the first and second seat bags 4 and 5 and backrest bag 10 of the first embodiment is composed only of a transversely or vertically elongated flat bag that is formed by folding a square airtight soft material in two and then heat-sealing its peripheral edge portions. However, each of the first and second seat bags 4 and 5 and backrest bag 10 of the lounger-type air massager according to the second embodiment comprises an inside airtight bag 21 and a sheathing bag 22 containing the inside airtight bag 21.

The inside airtight bag 21 is composed only of a transversely or vertically elongated flat bag that is formed by folding a square airtight soft material in two and then heat-sealing its peripheral edge portions. Any fixing holes used for fixing the inside airtight bag 21 to a predetermined position on each of a seat portion 2 and a backrest portion 3 by means of fixtures 8 are not formed in the peripheral edge portion located outside of the heat-sealing line 6. The inside airtight bag 21 has a charging/exhaust port (not shown). As compressed air is fed into or discharged from the internal space of the inside airtight bag 21 through the charging/exhaust port, the inside airtight bag 21 inflates or deflates.

The sheathing bag 22 is a cloth bag that is soft and large enough not to hinder the inflation of the inside airtight bag 21. In the sheathing bag 22 of each of the first and second seat bags 4 and 5, as shown in FIG. 8, one of its two opposite end edge portions which extend in the longitudinal direction, is made wider than the other, and fixing holes 7 into which the fixtures 8 are inserted, are formed in this wider, longitudinally extending end edge portion. The wider, longitudinally extending one end edge portion constitutes a fixing portion 4*a* or 5*a* of each of the first and second seat bags 4 and 5, while the narrower, longitudinally extending other end edge portion constitutes a free end portion 4*b* or 5*b*. Also, in the sheathing bag 22, an opening (not shown) through which the charging/exhaust port of the inside airtight bag 21 is exposed, is formed.

In the sheathing bag 22 of the backrest bag 10, as shown in FIG. 8, one of its two opposite end edge portions which extend in the transverse direction, is made wider than the other, and fixing holes 7 in which the fixtures 8 are inserted are formed in this wider, transversely extending end edge portion. The wider, transversely extending one end edge portion constitutes a fixing portion 10*a* of the backrest bag 10, while the narrower, transversely extending other end edge portion constitutes a free end portion 10*b*. Also, in the sheathing bag 22, an opening (not shown) through which the charging/exhaust port of the inside airtight bag 21 is exposed, is formed.

As shown in FIGS. 8 to 10, the first and second seat bags 4 and 5 and backrest bag 10 of the lounger-type air massager according to the second embodiment structured in this manner are fixed to the aforesaid predetermined positions on the seat portion 2 and the backrest portion 3 by means of the fixtures 8 inserted into the fixing holes 7 with the fixing portions 4*a* and 5*a* being located on the rear end side (i.e., backrest side) of the seat portion 2 and with the fixing portion 10*a* being located on the upper end side of the backrest portion 3.

Each of the first and second seat bags 4 and 5 and backrest bag 10 of the lounger-type air massager according to the second embodiment operates in the same manner and produces the same effect as each of the first and second seat bags 4 and 5 and backrest bag 10 of the lounger-type air massager according to the foregoing first embodiment.

Since each of the first and second seat bags 4 and 5 and backrest bag 10 of the second embodiment has a dual structure, as mentioned before, force applied to the fixing portion 4*a*, 5*a* or 10*a* (i.e., of the sheathing bag 22) when the inside airtight bag 21 is inflated is smaller than the force applied to the integral fixing portion 4*a*, 5*a* or 10*a* of each of the first and second seat bags 4 and 5 and backrest bag 10 according to the foregoing first embodiment when those bags are inflated. Thus, the life of each of the first and second seat bags 4 and 5 and backrest bag 10 according to the second embodiment is longer than that of their counterparts according to the foregoing first embodiment.

The present invention is not limited to these first and second embodiments. For example, the bag for air massage may be provided only on the backrest portion 3 without being provided on the seat portion 2. In contrast to this, the bag for air massage may be provided only on the seat portion 2 without being provided on the backrest portion 3. Also, a desired number of air massaging bags may be provided on desired places of each of the seat portion 2 and the backrest portion 3.

Referring now to FIGS. 11 to 14, a lounger-type air massager according to a third embodiment of the present invention will be described in detail.

Figure 11:
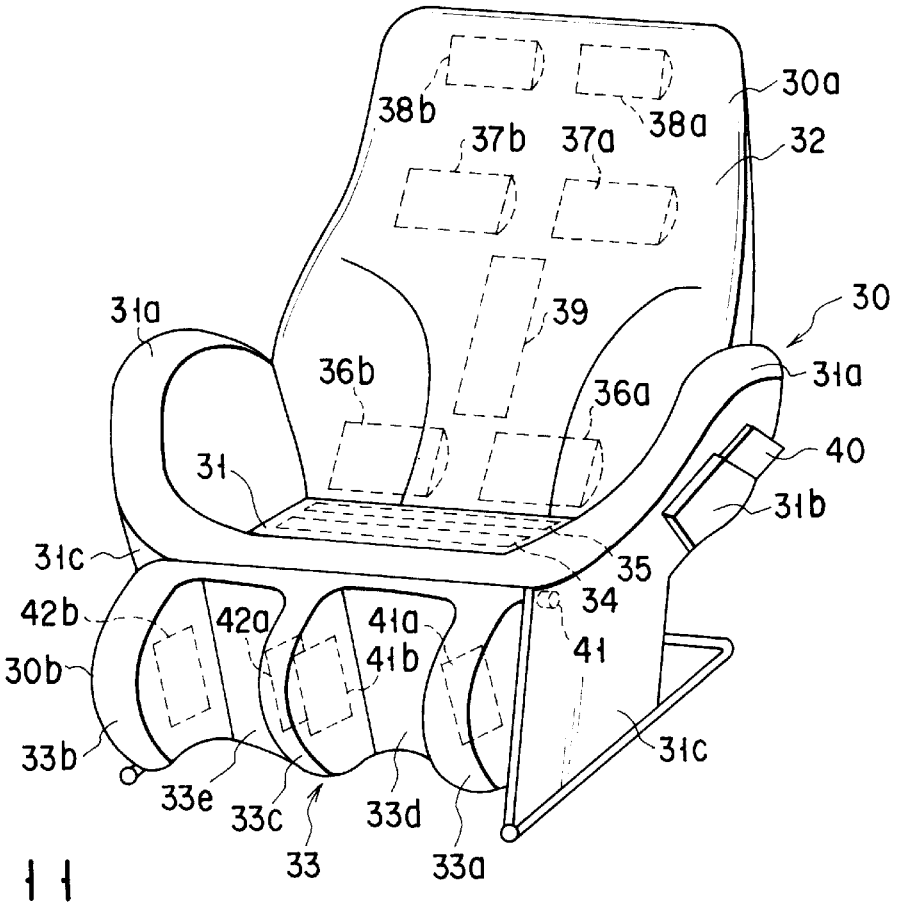
FIG. 11 is a perspective view showing the whole structure of a lounger-type air massager according to a third embodiment of the present invention.

FIG. 11 shows a structure of the lounger-type air massager according to the third embodiment of the present invention. A lounger body which is designated by reference numeral 30 in FIG. 11, includes a seat portion 31, a backrest portion 32 attached to the rear end of the seat portion 2 with inclination at a predetermined angle thereto, a hassock portion 33 attached to the front end of seat portion 31, and a pair of armrest portions 31*a* arranged on the opposite ends of the seat portion 31 in its width direction.

According to the present invention, the armrest portions 31*a* may be omitted, and the backrest portion 32 may be attached to the rear end of the seat portion 31 by means of reclining mechanism.

A thigh bag 34 for massaging the thighs of a person seated on the lounger-type air massager according to the third embodiment is disposed on the upper surface of the seat portion 31 in the vicinity of the front edge of the upper surface, while a buttock bag 35 for massaging the buttocks of the seated person is disposed on the upper surface in the vicinity of the rear edge (i.e., in the vicinity of the backrest portion). Each of the thigh bag 34 and buttock bag 35 is formed of a transversely elongated bag of an airtight soft material, extends parallel to each other, and substantially covers the whole width of the seat portion 31. Each of the thigh bag 34 and buttock bag 35 has a charging/exhaust port (not shown), and inflates or deflates when compressed air is fed thereinto or discharged therefrom through the charging/exhaust port.

A pair of loin bags 36*a* and 36*b* for massaging the loin of the seated person are arranged on the lower end portion of the front surface of the backrest portion 3 so as to be spaced from each other in the width direction of the front surface. A pair of neck/shoulder bags 38*a* and 38*b* for massaging the neck and shoulders of the seated person are arranged on the upper end portion of the aforesaid front surface so as to be spaced from each other in the width direction of the front surface. A pair of back bags 37*a* and 37*b* for massaging regions on the back of the seated person located near the underside of the scapulas of the seated person are arranged just under the pair of neck/shoulder bags 38*a* and 38*b* on the aforesaid front surface so as to be spaced from each other in the width direction of the front surface. One vertically elongated backbone-line bag 39 for massaging the muscles along the backbone is disposed between the pair of back bags 37*a* and 37*b* and the pair of loin bags 36*a* and 36*b* on the aforesaid front surface, and extends between the pair of back bags 37*a* and 37*b* and the pair of loin bags 36*a* and 36*b* at the center of the aforesaid front surface in the transverse direction thereof.

Each of the loin bags 36*a* and 36*b*, back bags 37*a* and 37*b*, and backbone-line bag 39 all of which are arranged on the front surface of the backrest portion 3, like the thigh bag 34 and buttock bag 35 on the upper surface of the seat portion 31, is formed of a transversely or vertically elongated bag of an airtight soft material, has a charging/exhaust port (not shown), and inflates or deflates as compressed air is fed into or discharged from the bag through the charging/exhaust port.

The lounger body 30 in which the thigh bag 34 and buttock bag 35 are arranged at the predetermined positions on the upper surface of the seat portion 31 and the loin bags 36*a* and 36*b*, neck/shoulder bags 38*a* and 38*b*, back bags 37*a* and 37*b*, and backbone-line bag 39 are arranged at the predetermined positions on the front surface of the backrest portion 3, is covered by a soft top cloth 30*a* that allows free inflation of those bags. A pocket-shaped storage portion 31*a* is provided in the outer surface of one of the pair of armrest portions 31*a*, and a remote controller 40 for a compressed air control device which will be mentioned later, is releasably held in the storage portion 31*a*.

The hassock portion 33 is connected to pivots 41 located in the vicinity of the upper ends of the front end portions of a pair of support legs 31*c* of the seat portion 31 on the upper ends by means of an angle setting means such as a ratchet mechanism (not shown) or the like, and can be positioned selectively at a plurality of angles by means of the angle setting means in a manner such that it projects forward from the seat portion 31.

The hassock portion 33 structured as described above can carry thereon that part (lower leg) of each leg of the person seated on the lounger-type air massager according to the third embodiment which extends between the knee and the ankle. When the hassock portion 33 is not used, the whole hassock portion 33 can be stored between the front end portions of the pair of support legs 31*c* of the seat portion 31, as shown in FIG. 11.

The hassock portion 33 includes side walls 33*a* and 33*b* on its transversely opposite ends, and also includes an intermediate wall 33*c* at the center in the width direction of the hassock portion 33. The pair of side walls 33*a* and 33*b* and the intermediate wall 33*c* are parallel to one another, thus creating a pair of treatment grooves 33*d* and 33*e* for carrying thereon the lower legs of the seated person, between the intermediate wall 33 and the pair of side walls 33*a* and 33*b*, each of the grooves having a substantially U-shaped cross section.

In order to massage the lower legs of the seated person laid on the pair of treatment grooves 33*d* and 33*e*, a pair of leg bags 41*a* and 41*b* are provided on the inner surface of the one side wall 33*a* corresponding to the one treatment groove 33*d* and one side surface of the intermediate wall 33*c*, while another pair of leg bags 42*a* and 42*b* are provided on the inner surface of the other side wall 33*b* corresponding to the other treatment groove 33*e* and the other side surface of the intermediate wall 33*c*.

Each leg bag out of these two pairs of leg bags 41*a*, 41*b* and 42*a*, 42*b*, like the thigh bag 34 and buttock bag 35 on the upper surface of the seat portion 31, is formed of a vertically elongated bag of an airtight soft material having a charging/exhaust port (not shown), and inflates or deflates as compressed air is fed or discharged through the charging/exhaust port. Each pair of leg bags out of the two pairs of leg bags 41*a*, 41*b* and 42*a*, 42*b*, hold the corresponding lower leg of the seated person which is laid on the corresponding treatment groove 33*d* or 33*e*, so as to embrace it from either side when inflated.

The hassock portion 33 on which the two pairs of leg bags 41*a*, 41*b* and 42*a*, 42*b* are located at the predetermined positions thereof, is covered by a soft top cloth 30*b* to conceal the two pairs of leg bags 41*a*, 41*b* and 42*a*, 42*b*.

Stored between the pair of support legs 31*c* of the seat portion 31 is a compressed air control device 50 (shown in FIG. 12) for controlling the feed and discharge of the compressed air into and from each of the thigh bag 34 and buttock bag 35 on the seat portion 31, the loin bags 36*a* and 36*b*, neck/shoulder bags 38*a* and 38*b*, back bags 37*a* and 37*b*, and backbone-line bag 39 on the backrest portion 3, and the two pairs of leg bags 41*a*, 41*b* and 42*a*, 42*b* on the hassock portion 33.

Figure 12:
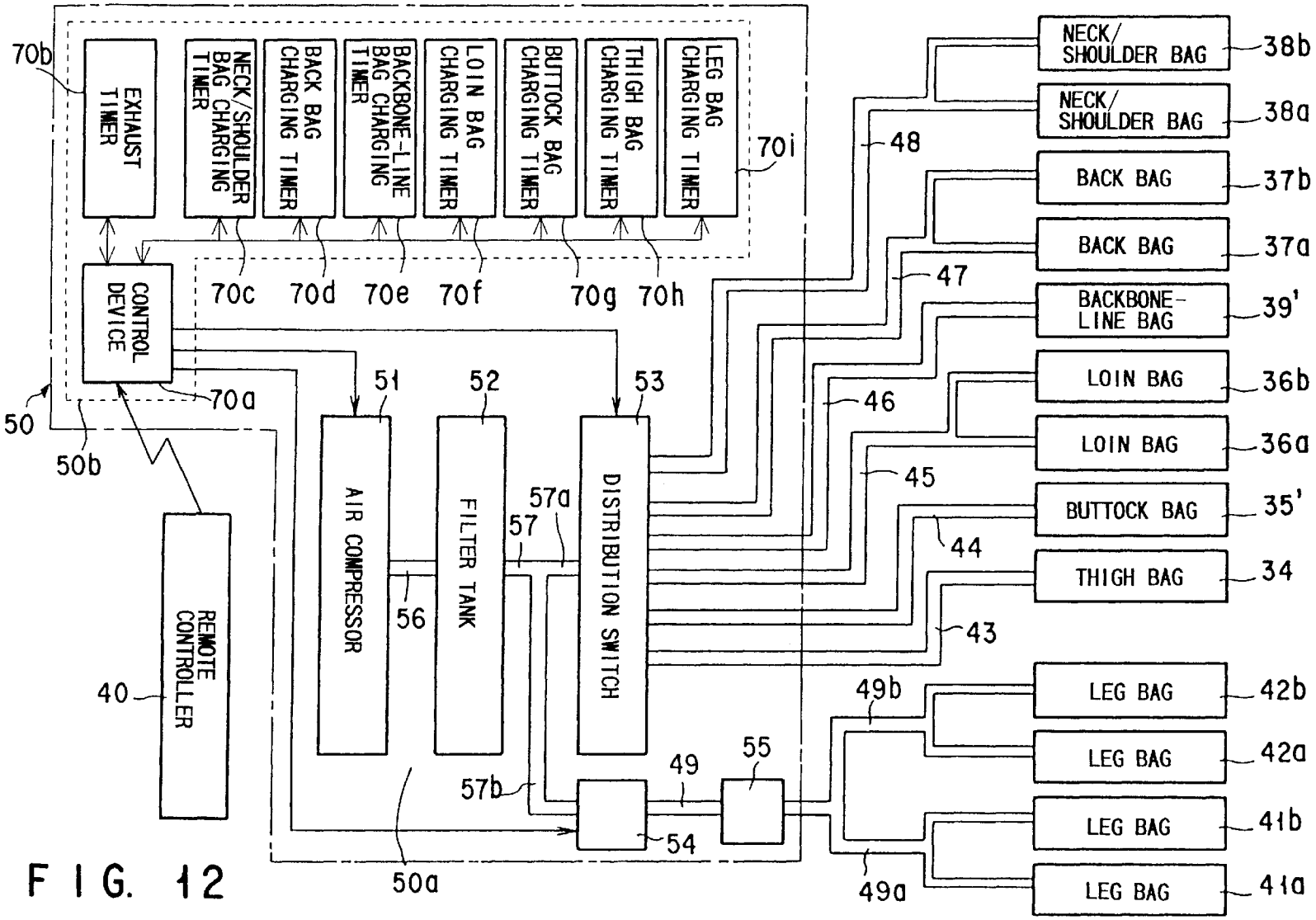
FIG. 12 is a block diagram schematically showing the structure of a compressed air control device of the lounger-type air massager according to the third embodiment of FIG. 11.

As shown in FIG. 12, the compressed air control device 50 comprises a compressed air charging/exhaust portion 50*a* which is connected to the charging/exhaust ports (not shown) of the aforesaid various bags 34, 35, 36*a*, 36*b*, 38*a*, 38*b*, 37*a*, 37*b*, 39, 41*a*, 41*b*, 42*a* and 42*b* by means of charging/exhaust pipes 43, 44, 45, 46, 47, 48 and 49 and feeds and discharges the compressed air into and from those various bags, and control means 50*b* for controlling the operation of the compressed air charging/exhaust portion 50*a*.

Each of the charging/exhaust pipes 43, 44, 45, 46, 47, 48 and 49 are formed of a flexible material, such as soft vinyl, so as to have the same diameter as to each other but not to hinder the free inflation of the aforesaid various bags corresponding thereto.

As shown in FIG. 12, the compressed air charging/exhaust portion 50*a* comprises an air compressor 51, a filter tank 52, a distribution switch 53, a solenoid-operated on-off valve 54, and a quick exhaust valve 55.

More specifically, the air compressor 51 is used as a compressed air source, and a filter tank 52 is connected to a compressed air discharge port of the air compressor 51 by means of a connecting pipe 56. The filter tank 52 is used to absorb the pulsation of the compressed air supplied from the air compressor 51, thereby smoothing the pressure of the compressed air to be flown out of the filter tank 52. A forked connecting pipe 57 is connected to a compressed air outlet of the filter tank 52. One branch pipe 57*a* of the connecting pipe 57 is connected to the distribution switch 53 to be used as an air distributing means, and the other branch pipe 57*b* is connected to the solenoid-operated on-off valve 54 to be used as a valve means.

The distribution switch 53 is a well-known rotary valve that is actuated by means of a motor or the like used in the conventional lounger-type air massager, and has one intake port connected with the branch pipe 57*a*, a plurality of distribution ports connected with all of the charging/exhaust pipes 43, 44, 45, 46, 47 and 48 excepting the charging/exhaust pipe 49 for the two pairs of leg bags 41*a*, 41*b* and 42*a*, 42*b* in the hassock portion 33, and one exhaust port. The distribution switch 53 rotates a flow changing rotor (not shown) by means of a motor (not shown) to make at least one selected distribution port connect with the intake port, and to make at least one remaining distribution port connect with the exhaust port. By doing this, the compressed air is selectively fed into the thigh bag 34 and buttock bag 35 on the seat portion 31, the loin bags 36*a* and 36*b*, neck/shoulder bags 38*a* and 38*b*, back bags 37*a* and 37*b*, and backbone-line bag 39 on the backrest portion 3, and selectively discharged from these bags.

The solenoid-operated on-off valve 54 is connected with the charging/exhaust pipe 49 for the two pairs of leg bags 41*a*, 41*b* and 42*a*, 42*b* on the hassock portion 33. The charging/exhaust pipe 49 is connected with the quick exhaust valve 55 to be used as a quick exhaust means for quickly discharging the compressed air from the two pairs of leg bags 41*a*, 41*b* and 42*a*, 42*b*, and then is branched into a pair of branch pipes 49*a* and 49*b* for each of the two pairs of leg bags 41*a*, 41*b* and 42*a*, 42*b*. Thereafter, each of the pair of branch pipes 49*a* and 49*b* is further branched to be connected with charging/exhaust ports (not shown) for each pair of the two pairs of leg bags 41*a*, 41*b* and 42*a*, 42*b*.

Figure 13:
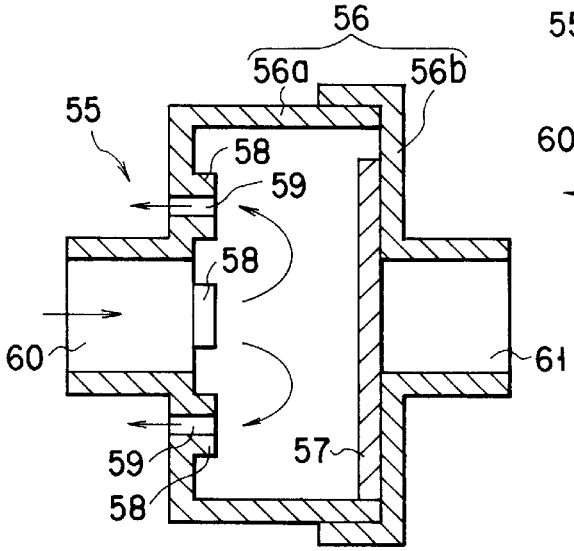
FIG. 13 is a longitudinal sectional view schematically showing a quick exhaust valve for quick exhaust of compressed air in the compressed air control device of FIG. 12, in a compressed air non-charging state (compressed air quick exhaust state)
Figure 14:
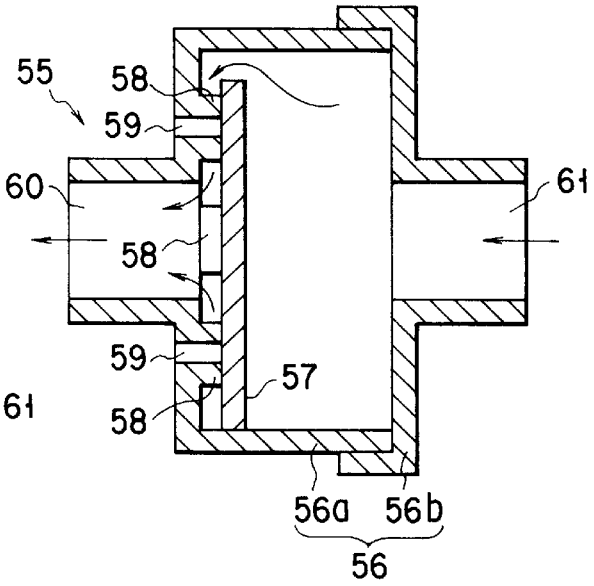
FIG. 14 is a longitudinal sectional view schematically showing the quick exhaust valve of FIG. 13 in a compressed air charging state.

FIG. 13 shows a longitudinal cross section of the quick exhaust valve 55 in a compressed air non-feeding state (compressed air quick exhaust state), and FIG. 14 shows that in a compressed air feeding state.

As seen from these drawings, the quick exhaust valve 55 includes a valve housing 56, a valve member 57, a plurality of spacers 58, and a plurality of quick exhaust ports 59. More specifically, the valve housing 56 is provided with a housing body 56*a* which has a short cylindrical peripheral wall and a side wall closing an opening at one end of the peripheral wall, and a housing lid 56*b* closing an opening at the other end of the peripheral wall of the housing body 56*a*. A first port 60 is formed in the center of the side wall of the housing body 56*a*, and a second port 61 is formed in the center of the housing lid 56*b*. The first port 60 of the housing body 56*a* is connected to the pair of branch pipes 49*a* and 49*b* for the two pairs of leg bags 41*a*, 41*b* and 42*a*, 42*b* shown in FIG. 12 and arranged in the hassock portion 33, and the second port 61 of the housing lid 56*b* is connected with the charging/exhaust pipe 49 that is connected to the solenoid-operated on-off valve 54 of FIG. 12.

The valve member 57 has a dish-like shape a diameter of which is smaller than the inner diameter of the valve housing 56, and is contained in the valve housing 56 to be movable along the longitudinal center line of the valve housing 56.

The plurality of spacers 58 are arranged on a concentric circle around the first port 60 to be spaced from one another on the inner surface of the aforesaid side wall of the housing body 56*a*, and the quick exhaust port 59 for connecting the inner space of the valve housing 56 and the outer space thereof is formed in each of the spacers 58.

The quick exhaust valve 55 structured as described above operates in the following manner. That is, in a compressed air feeding mode in which the compressed air is fed into the valve housing 56 through the second port 61 while the air compressor 51 is being operated, the valve member 57 is moved toward the aforesaid side wall of the housing body 56*a* by the pressure of the compressed air, and abuts against the projecting ends of the spacers 58, thereby closing the quick exhaust ports 59, as shown in FIG. 14. In this state, the first port 60 communicates with the second port 61 through a gap produced between the aforesaid side wall of the housing body 56*a* and the valve member 57 by the spacers 58, so that the compressed air introduced into the quick exhaust valve 55 through the second port 61 is fed from the first port 60 into the two pairs of leg bags 41*a*, 41*b* and 42*a*, 42*b* shown in FIG. 12 via the aforesaid gap and the pair of branch pipes 49*a* and 49*b*, as indicated by the arrows in FIG. 14.

In a compressed air non-feeding mode in which the operation of the air compressor 51 is stopped, the compressed air in the two pairs of leg bags 41*a*, 41*b* and 42*a*, 42*b* presses the valve member 57 by its own pressure to move the valve member 57 toward the housing lid 56*b* and abut against the inner surface of the housing lid 56*b*, thereby closing the second port 61. Accordingly, the compressed air flow out from the two pairs of leg bags 41*a*, 41*b* and 42*a*, 42*b* into the quick exhaust valve 55 via the first port 60, is quickly discharged to the outer space through the quick exhaust ports 59 of the spacers 58, as indicated by the arrows in FIG. 13. The exhaust efficiency of the quick exhaust valve 59 is higher than that of the distribution switch 53.

The control means 50*b* shown in FIG. 12 is composed of a well-known microcomputer that comprises a CPU (central processing unit), ROM (read-only memory), RAM (random access memory), etc. all of which are not shown, and is provided with a control device 70*a*, exhaust timer 70*b*, neck/shoulder bag charging timer 70*c*, back bag charging timer 70*d*, backbone-line bag charging timer 70*e*, loin bag charging timer 70*f*, buttock bag charging timer 70*g*, thigh bag charging timer 70*h*, and leg bag charging timer 70*i*.

The control device 70*a* is loaded with programs for executing various operation modes. The control device 70*a* controls the operations of the air compressor 51, distribution switch 53, and solenoid-operated on-off valve 54 in accordance with a selected operation mode, whereby the compressed air is selectively fed into the thigh bag 34 and buttock bag 35 on the seat portion 31, the loin bags 36*a* and 36*b*, neck/shoulder bags 38*a* and 38*b*, back bags 37*a* and 37*b*, and backbone-line bag 39 on the backrest portion 3, and is selectively discharged from these bags.

The various operation modes include a whole-body massage mode; upper-half-body massage mode; lower-half-body massage mode; a plurality of point massage modes for massaging various parts of the body, including the neck and shoulders, back, muscles along the backbone, loins, buttocks, thighs, and legs; and a plurality of leg-synchronized massage modes in which a leg point massage mode is combined with any one of the whole-body, upper-half-body, lower-half-body massage mode or any one of the point massage modes except the leg point massage mode. These various operation modes are inputted to the control device 70*a* by means of the remote controller 40 at the armrest portion 31*a* shown in FIG. 11.

As shown in FIG. 12, the exhaust timer 70*b* is connected to the control device 70*a*. The exhaust timer 70*b* sets a common exhaust time to all of the thigh bag 34 and buttock bag 35 on the seat portion 31, the loin bags 36*a* and 36*b*, neck/shoulder bags 38*a* and 38*b*, back bags 37*a* and 37*b*, and backbone-line bag 39 on the backrest portion 3, and the two pairs of leg bags 41*a*, 41*b* and 42*a*, 42*b* on the hassock portion 33, the exhaust time defining a compressed air discharge time of these bags when these bags are subjected to the body weight of the seated person and the compressed air is discharged therefrom while the feed of the compressed air into these bags is stopped. When each of the aforesaid various operation modes is set, the control device 70*a* intermittently stops the operation of the air compressor 51 for a predetermined time in accordance with the exhaust time set in the exhaust timer 70*b*, and in synchronism with this, brings the distribution switch 53 and solenoid-operated on-off valve 54 to an exhaust state.

As shown in FIG. 12, the control device 70*a* is further connected with each of the neck/shoulder bag charging timer 70*c* for the neck/shoulder bags 38*a* and 38*b*, back bag charging timer 70*d* for the back bags 37*a* and 37*b*, backbone-line bag charging timer 70*e* for the backbone-line bag 39, loin charging timer 70*f* for the loin bags 36*a* and 36*b*, buttock bag charging timer 70*g* for the buttock bag 35, thigh bag charging timer 70*h* for the thigh bag 34, and leg bag charging timer 70*i* for the leg bags 41*a*, 41*b*, 42*a* and 42*b*.

Each of these charging timers 70*c* to 70*i* sets the time for feeding the compressed air into the corresponding one of the bags 38*a*, 38*b*, 37*a*, 37*b*, 39, 36*a*, 36*b*, 35, 34, 41*a*, 41*b*, 42*a* and 42*b*. And, the charging time set in each of the backbone-line bag charging timer 70*e* and buttock bag charging timer 70*g*, is longer than the charging time set in each of the other charging timers 70*c*, 70*d*, 70*f*, 70*h* and 70*i*.

The control device 70*a* intermittently continues the operation of the air compressor 51 in accordance with the charging time set in that one of the charging timers 70*c* to 70*i* which corresponds to a selected operation mode when each of the aforesaid various operation modes is set, and in synchronism with this, controls the distribution switch 53 and solenoid-operated on-off valve 54 so that the bag or bags corresponding to the selected operation mode is or are in a charging state.

The bag or bags corresponding to the selected operation mode inflates or inflate as it is or they are charged with the compressed air from the air compressor 51 through the filter tank 19, distribution switch 53, and/or solenoid-operated on-off valve 54 within the time set by the correspond charging timer, and press the corresponding part(s) of the body of the seated person. Also, the bag or bags corresponding to the selected operation mode deflates or deflate as the compressed air is discharged from its inner space or their inner spaces within the common exhaust time set in the exhaust timer 70*b*.

As the bag or bags corresponding to the selected operation mode repeatedly inflate(s) and deflate(s) in this manner, a part or various parts of the body of the seated person correspond to the bag(s) repeatedly inflating and deflating, is or are massaged.

Each of a force applied from the body weight of the seated person to the buttock bag 35 and a force applied from the body weight of the seated person to the backbone-line bag 39 while the backrest portion 3 is largely inclined is greater than each of forces applied from the body weight of the seated person to the other bags (i.e., neck/shoulder bags 38*a* and 38*b*, back bags 37*a* and 37*b*, loin bags 36*a* and 36*b*, thigh bag 34, and leg bags 41*a*, 41*b* and 42*a*, 42*b*) than the aforesaid bags 35 and 39. Accordingly, within the same exhaust time, the quantity of compressed air discharged from each of the buttock bag 35 and backbone-line bag 39 is larger than the quantity of compressed air discharged from each of the other bags than those bags 35 and 39. This means that, after the same exhaust time is up, the quantity of compressed air remaining in each of the buttock bag 35 and backbone-line bag 39 is smaller than the quantity of compressed air remaining in each of the other bags than those bags 35 and 39.

As mentioned before, therefore, the charging time set in each of the backbone-line bag charging timer 70*e* and buttock bag charging timer 70*g* among the charging timers 70*c* to 70*i*, is set longer than the charging time set in each of the other charging timers 70*c*, 70*d*, 70*f*, 70*h* and 70*i*. By doing this, at the next compressed air charging state, the quantity of compressed air fed into each of the buttock bag 35 and backbone-line bag 39 is larger than the quantity of compressed air fed into each of the other bags than those bags 35 and 39.

As a result of this, after the charging time is up, the volume of inflation of the buttock bag 35 or backbone-line bag 39 in the operation mode in which at least one of the buttock bag 35 and backbone-line bag 39 is used can be made substantially equal to the volume of inflation of each of the other bags than those bags 35 and 39, although the force applied from the body weight of the seated person to each of the bags 35 and 39 is greater than the force applied to each of the other bags. Even in the operation mode in which at least one of the buttock bag 35 and backbone-line bag 39 is used, therefore, the various bags inflated and deflated in the aforesaid operation mode can press their corresponding parts of the body of the seated person with a uniform strength, thereby providing a satisfactory massage effect.

According to this embodiment, moreover, the quick exhaust valve 55 is provided in the charging/exhaust pipe 49 for the leg bags 41*a*, 41*b*, 42*a* and 42*b* in the hassock portion 33 to each of which the smallest force is applied from the body weight of the seated person, so that the leg bags 41*a*, 41*b*, 42*a* and 42*b* can be deflated in the same manner as the other bags within the common exhaust time in the leg point massage mode in which only the leg bags 41*a*, 41*b*, 42*a* and 42*b* are used, and in each of the leg-synchronized massage modes in which the leg bags 41*a*, 41*b*, 42*a* and 42*b* are used in combination with the other bags.

Without the quick exhaust valve 55, the bags used with the leg bags 41*a*, 41*b*, 42*a* and 42*b*, together with these leg bags, would have to be inflated after the those leg bags are fully deflated. In this case, therefore, the inflation/deflation cycle of each of the leg bags 41*a*, 41*b*, 42*a* and 42*b* and the other bags used in combination with these leg bags in the leg point massage mode and leg-synchronized massage modes must be longer than the inflation/deflation cycle of each of the other bags than the leg bags used when the leg bags 41*a*, 41*b*, 42*a* and 42*b* are not used, so that a satisfactory massage effect cannot be obtained efficiently.

As compared with the case without the use of the quick exhaust valve 55, this embodiment in which the leg bags 41*a*, 41*b*, 42*a* and 42*b* can be inflated and deflated in the same cycles as the other bags, as mentioned before, can produce efficiently a satisfactory massage effect even in the leg point massage mode and leg-synchronized massage modes.

Figure 15:
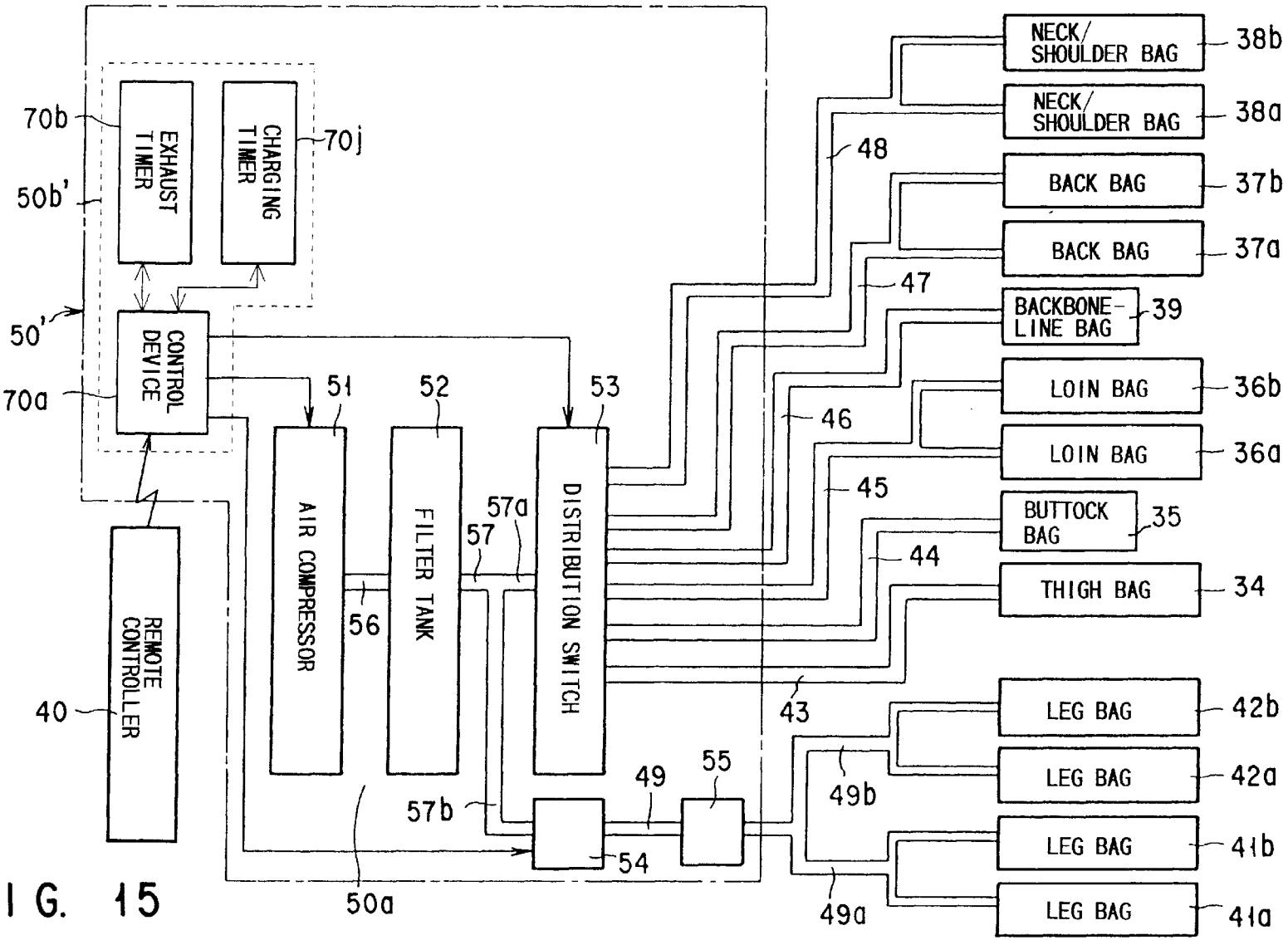
FIG. 15 is a block diagram schematically showing the structure of a compressed air control device of a lounger-type air massager according to a fourth embodiment of the present invention.

FIG. 15 schematically shows a structure of a compressed air control device 50', which is a main part of a lounger-type air massager according to a fourth embodiment of the present invention.

The structure of the lounger-type air massager according to the fourth embodiment is the same as the structure of the lounger-type air massager according to the third embodiment of the present invention described before with reference to FIGS. 11 to 14 except that a part of the structure of control means 50*b*' of the compressed air control device 50' shown in FIG. 15 and each of the sizes of a buttock bag 35' and a backbone-line bag 39' are different from those of the lounger-type air massager according to the foregoing third embodiment of the present invention. Accordingly, those components in the lounger-type air massager according to the fourth embodiment which are identical with or equivalent to the corresponding components of the lounger-type air massager according to the foregoing third embodiment of the present invention are designated by the same reference numerals that are used to designate the corresponding components of the lounger-type air massager according to the foregoing third embodiment, and a detailed descriptions of those identical or equivalent components are omitted.

As shown in FIG. 15, the control means 50*b*' of the compressed air control device 50' according to the fourth embodiment comprises a charging timer 70*j* which is common to the neck/shoulder bags 38*a* and 38*b*, back bags 37*a* and 37*b*, backbone-line bag 39', loin bags 36*a* and 36*b*, buttock bag 35', thigh bag 34, and leg bags 41*a*, 41*b*, 42*a* and 42*b*, in place of the neck/shoulder bag charging timer 70*c*, back bag charging timer 70*d*, backbone-line bag charging timer 70*e*, loin bag charging timer 70*f*, buttock bag charging timer 70*g*, thigh bag charging timer 70*h*, and leg bag charging timer 70*i* of the control means 50*b* of the compressed air control device 50 according to the third embodiment shown in FIG. 12. In the charging timer 70*j*, a common compressed air charging time is set to all those bags.

Thus, the control means 50*b*' of the compressed air control device 50' according to the fourth embodiment makes the air compressor 17 operate intermittently at every predetermined charging time set in the charging timer 70*j* while any of the various operation modes (massage modes) described in connection with the foregoing third embodiment is set, and makes the distribution switch 53 and/or solenoid-operated on-off valve 54 operate to feed the compressed air into the bag or bags that correspond to the selected operation mode.

According to this embodiment, the common exhaust timer 70*b* sets the same compressed air exhaust time for all of the bags and the common charging timer 70*j* sets the same compressed air charging time for all of the bags. Besides, the capacity of each of the buttock bag 35 and backbone-line bag 39 each of which is subjected to a greater force from the body weight of the seated person than the other bags, is set to be smaller than the capacity of each of the aforesaid other bags. Thus, in the operation (massage) modes in which at least one of the buttock bag 35 and the backbone-line bag 39 is used in combination with the aforesaid other bags, the volume of inflation of the buttock bag 35 or backbone-line bag 39 after the predetermined charging time is up can be made substantially equal to the volume of inflation of each of the aforesaid other bags, although the force applied from the body weight of the seated person to each of the bags 35 and 39 is greater than the force applied to each of the other bags. Thus, when the inflation of each of the buttock bag 35 and/or backbone-line bag 39 used and the aforesaid other bags is completed at the same time, the hardness of each of these bags is substantially equal to one another so that the forces applied from the bags to the corresponding parts of the seated person are substantially equal to each other. Accordingly, the seated person can obtain a satisfactory massage effect from any of those bags used with respect to all of the corresponding parts.

Figure 16:
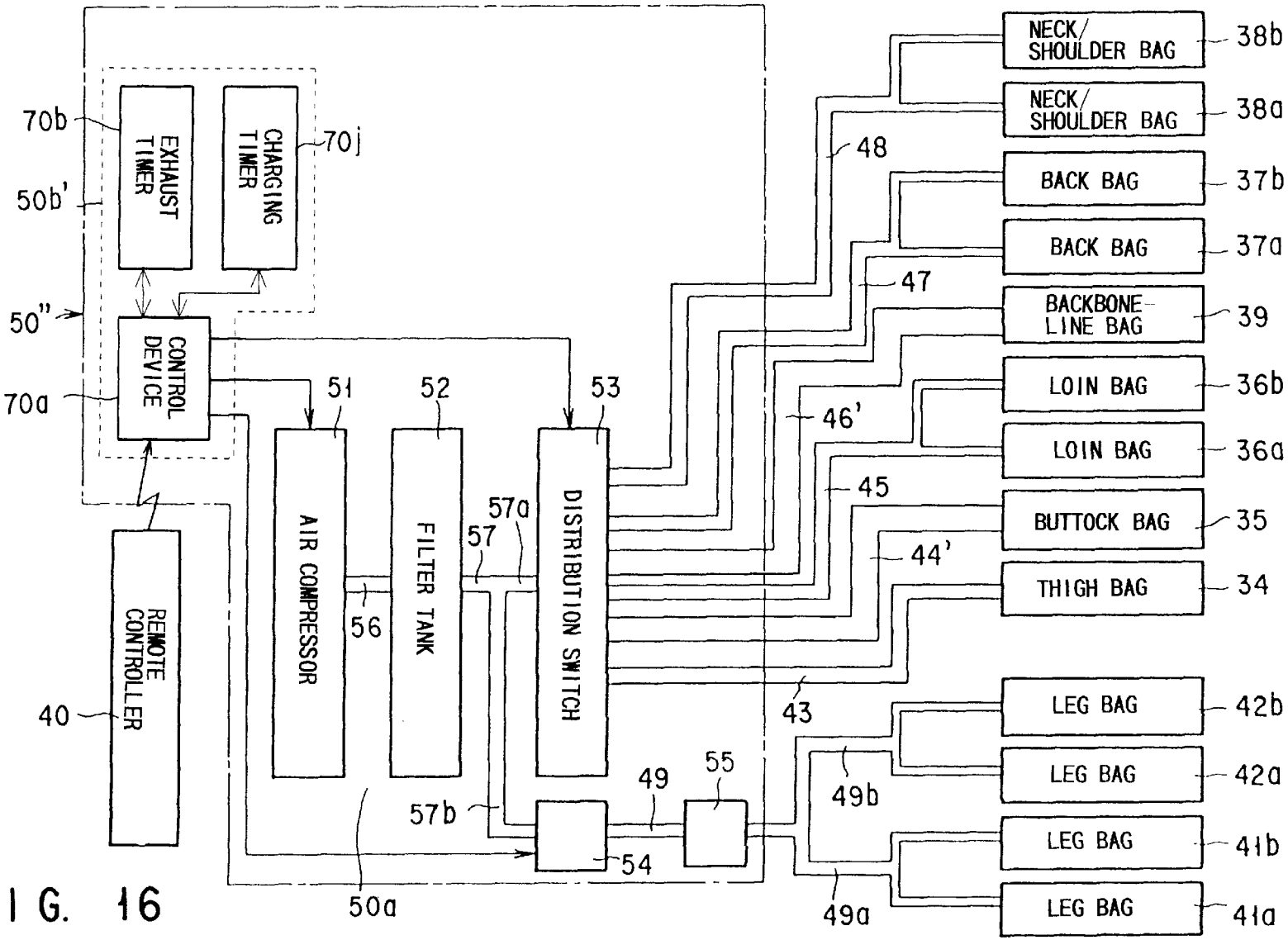
FIG. 16 is a block diagram schematically showing the structure of a compressed air control device of a lounger-type air massager according to a fifth embodiment of the present invention.

FIG. 16 schematically shows a structure of a compressed air control device 50" which is a main part of a lounger-type air massager according to a fifth embodiment of the present invention.

The structure of the lounger-type air massager according to the fifth embodiment is the same as the structure of the lounger-type air massager according to the third embodiment of the present invention described before with reference to FIGS. 11 to 14 except that a part of the structure of control means 50*b*' of the compressed air control device 50" shown in FIG. 16 and each of the sizes of charging/exhaust pipes 44' and 46' for the buttock bag 35 and backbone-line bag 39 are different from those of the lounger-type air massager according to the foregoing third embodiment of the present invention. Accordingly, those components in the lounger-type air massager according to the fifth embodiment which are identical with or equivalent to the corresponding components of the lounger-type air massager according to the foregoing third embodiment of the present invention are designated by the same reference numerals that are used to designate the corresponding components of the lounger-type air massager according to the foregoing third embodiment, and detailed descriptions of those identical or equivalent components are omitted.

As shown in FIG. 16, the control means 50*b*' of the compressed air control device 50" according to the fifth embodiment comprises a charging timer 70*j* which is common to the neck/shoulder bags 38*a* and 38*b*, back bags 37*a* and 37*b*, backbone-line bag 39, loin bags 36*a* and 36*b*, buttock bag 35, thigh bag 34, and leg bags 41*a*, 41*b*, 42*a* and 42*b*, in place of the neck/shoulder bag charging timer 70*c*, back bag charging timer 70*d*, backbone-line bag charging timer 70*e*, loin bag charging timer 70*f*, buttock bag charging timer 70*g*, thigh bag charging timer 70*h*, and leg bag charging timer 70*i* of the control means 50*b* of the compressed air control device 50 according to the third embodiment shown in FIG. 12. In the charging timer 70*j*, a common compressed air charging time is set to all those bags.

Thus, the control means 50*b*' of the compressed air control device 50" according to the fifth embodiment makes the air compressor 17 operate intermittently at every predetermined charging time set in the charging timer 70*j* while any of the various operation modes (massage modes) described in connection with the foregoing third embodiment is set, and makes the distribution switch 53 and/or solenoid-operated on-off valve 54 operate to feed the compressed air into the bag or bags that correspond to the selected operation mode.

According to this embodiment, the common exhaust timer 70*b* sets the same compressed air exhaust time for all of the bags, and the common charging timer 70*j* sets the same compressed air charging time for all of the bags. In order to set the flow resistance of each of the charging/exhaust pipes 44' and 46' for the buttock bag 35 and backbone-line bag 39 each of which is subjected to greater force from the body weight of the seated person than each of the other bags, lower than the flow resistance of each of the charging/exhaust pipes 43, 45, 47, 48 and 49 for the other bags, the length of each of the charging/exhaust pipes 44' and 46' for the buttock bag 35 and backbone-line bag 39 and that of each of the charging/exhaust pipes 43, 45, 47, 48 and 49 for the other bags are set to be equal to one another, but the pipe diameter of each of the charging/exhaust pipes 44' and 46' for the buttock bag 35 and backbone-line bag 39 is set to be larger than the pipe diameter of each of the charging/exhaust pipes 43, 45, 47, 48 and 49 for the other bags. Thus, the quantity of compressed air that can be fed into or discharged from each of the buttock bag 35 and backbone-line bag 39 each of which is subjected to a greater force from the body weight of the seated person than the other bags, in each unit time (charging/exhaust efficiency) can be made larger than the quantity of compressed air that can be fed into or discharged from each of the aforesaid other bags in each unit time (charging/exhaust efficiency).

In order to produce the aforesaid difference in flow resistance between each of the charging/exhaust pipes 44' and 46' for the buttock bag 35 and backbone-line bag 39 and each of the charging/exhaust pipes 43, 45, 47, 48 and 49 for the other bags, the pipe diameter of each of the charging/exhaust pipes 44' and 46' for the buttock bag 35 and backbone-line bag 39 and the pipe diameter of each of the charging/exhaust pipes 43, 45, 47, 48 and 49 for the other bags are set to be equal to one another, but the length of each of the charging/exhaust pipes 44' and 46' for the buttock bag 35 and backbone-line bag 39 is set to be shorter than the length of each of the charging/exhaust pipes 43, 45, 47, 48 and 49 for the other bags. Alternatively, the pipe diameter and length of each of the charging/exhaust pipes 44' and 46' for the buttock bag 35 and backbone-line bag 39 and those of each of the charging/exhaust pipes 43, 45, 47, 48 and 49 for the other bags are set to be equal to one another, but a charging/exhaust resisting member is fitted in each of the charging/exhaust pipes 43, 45, 47, 48 and 49 for the other bags.

Thus, in the operation (massage) modes in which at least one of the buttock bag 35 and the backbone-line bag 39 is used in combination with the aforesaid other bags, the volume of inflation of the buttock bag 35 or backbone-line bag 39 after the predetermined charging time is up can be made substantially equal to the volume of inflation of each of the aforesaid other bags, although the force applied from the body weight of the seated person to each of the buttock bag 35 and the backbone-line bag 39 is greater than the force applied to each of the other bags. Thus, when the inflation of each of the buttock bag 35 and/or backbone-line bag 39 used and the aforesaid other bags is completed at the same time, the hardness of each of these bags is substantially equal to one another so that the forces applied from these bags to the corresponding parts of the seated person are substantially equal to each other. Accordingly, the seated person can obtain a satisfactory massage effect from any of those bags used with respect to all of the corresponding parts.

Figure 17:
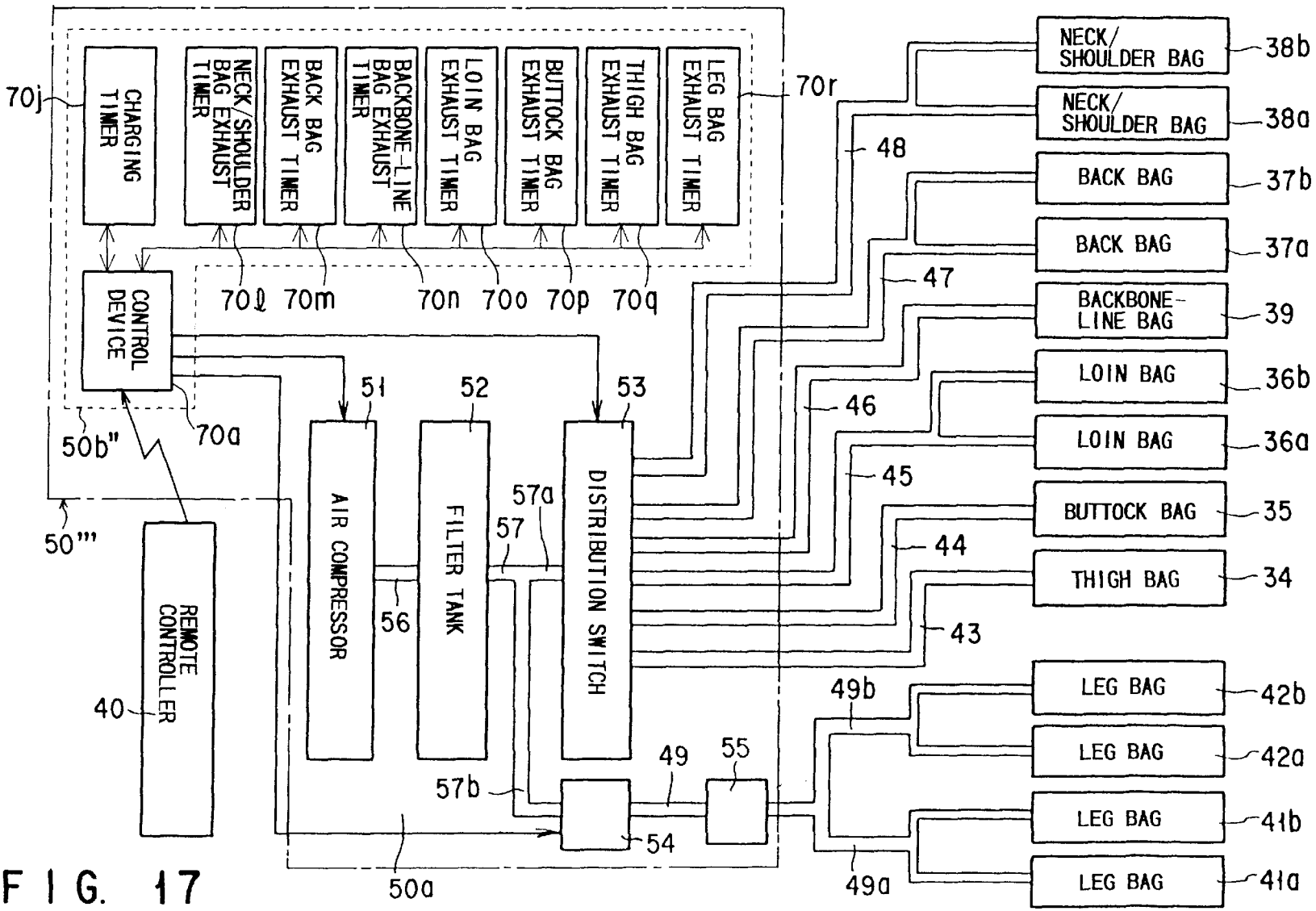
FIG. 17 is a block diagram schematically showing the structure of a compressed air control device of a lounger-type air massager according to a sixth embodiment of the present invention.

FIG. 17 schematically shows a structure of a compressed air control device 50''' which constitutes a main part of a lounger-type air massager according to a sixth embodiment of the present invention.

The structure of the lounger-type air massager according to the sixth embodiment is the same as the structure of the lounger-type air massager according to the third embodiment of the present invention described before with reference to FIGS. 11 to 14 except that a part of the structure of a control means **50*b*" of the compressed air control device 50''' shown in FIG. 17 is different from a part of the structure of the control means 50*b* of the compressed air control device 50** of the lounger-type air massager according to the foregoing third embodiment of the present invention. Accordingly, those components of the lounger-type air massager according to the sixth embodiment which are identical with or equivalent to the corresponding components of the lounger-type air massager according to the foregoing third embodiment of the present invention are designated by the same reference numerals that are used to designate the corresponding components of the lounger-type air massager according to the foregoing third embodiment, and a detailed descriptions of the identical or equivalent components are omitted.

As shown in FIG. 17, the control means **50*b*" of the compressed air control device 50''' according to the sixth embodiment comprises a common charging timer 70*j* for all of the neck/shoulder bags 38*a* and 38*b*, back bags 37*a* and 37*b*, backbone-line bag 39, loin bags 36*a* and 36*b*, buttock bag 35, thigh bag 34, and leg bags 41*a*, 41*b*, 42*a* and 42*b*, in place of the neck/shoulder bag charging timer 70*c*, back bag charging timer 70*d*, backbone-line bag charging timer 70*e*, loin bag charging timer 70*f*, buttock bag charging timer 70*g*, thigh bag charging timer 70*h*, and leg bag charging timer 70*i* of the control means 50*b* of the compressed air control device 50 according to the third embodiment shown in FIG. 12. In the charging timer 70*j***, a common compressed air charging time is set to all of those bags.

Thus, the control means **50*b*" of the compressed air control device 50''' according to the sixth embodiment makes the air compressor 17 operate intermittently at every predetermined charging time set in the charging timer 70*j* while any of the various operation modes (massage modes) described in connection with the foregoing third embodiment is set, and makes the distribution switch 53 and/or solenoid-operated on-off valve 54** operate to feed the compressed air into the bag or bags that correspond to the selected operation mode.

In the control means **50*b*" of the compressed air control device 50''' according to the sixth embodiment, as shown in FIG. 17, moreover, the control device 70*a* is connected with each of a neck/shoulder bag exhaust timer 70*l* for the neck/shoulder bags 38*a* and 38*b*, back bag exhaust timer 70*m* for the back bags 37*a* and 37*b*, backbone-line bag exhaust timer 70*n* for the backbone-line bag 39, loin bag exhaust timer 70*o* for the loin bags 36*a* and 36*b*, buttock bag exhaust timer 70*p* for the buttock bag 35, thigh bag exhaust timer 70*q* for the thigh bag 34, and leg bag exhaust timer 70*r* for the leg bags 41*a*, 41*b*, 42*a* and 42*b*, in place of the common exhaust timer 70*b* of the control means 50*b* of the compressed air control device 50 according to the third embodiment shown in FIG. 12**.

Each of the exhaust timers **70*l* to 70*r* sets the time for discharging the compressed air from the corresponding one of the bags 38*a*, 38*b*, 37*a*, 37*b*, 39, 36*a*, 36*b*, 35, 34, 41*a*, 41*b*, 42*a* and 42*b*. Exhaust time set in each of the backbone-line bag exhaust timer 70*n* and buttock bag exhaust timer 70*p*, among those exhaust timers 70*l* to 70*r*, is shorter than exhaust time set in each of the other exhaust timers 70*l*, 70*m*, 70*o*, 70*q* and 70*r***.

The control device **70*a* intermittently stops the operation of the air compressor 51 in accordance with the exhaust time set in that one of the exhaust timers 70*l* to 70*r* which corresponds to a selected operation mode when each of the aforesaid various operation (massage) modes is set, and in synchronism with this, controls the distribution switch 53 and solenoid-operated on-off valve 54** so that the bag or bags corresponding to the selected operation mode is or are in a non-charging state.

The compressed air having been fed into the bag or bags corresponding to the selected operation mode during a predetermined compressed air feeding time, is discharged from the bag or bags corresponding to the selected operation mode to the outside of the bag or bags, through the distribution switch 53 and/or quick exhaust valve 55 within a time set by the corresponding exhaust timer.

As the bag or bags corresponding to the selected operation mode repeatedly inflates and deflates in this manner, a part or various parts of the body of the seated person, which correspond to the bag or bags repeatedly inflating and deflating, is or are massaged.

Each of a force applied from the body weight of the seated person to the buttock bag 35 and a force applied from the body weight of the seated person to the backbone-line bag 39 while the backrest portion 3 is largely inclined is greater than a force applied from the body weight of the seated person to each of the other bags (i.e., neck/shoulder bags **38*a* and 38*b*, back bags 37*a* and 37*b*, loin bags 36*a* and 36*b*, thigh bag 34, and leg bags 41*a*, 41*b* and 42*a*, 42*b*). Accordingly, within the same exhaust time, the quantity of compressed air discharged from each of the buttock bag 35** and backbone-line bag 39 is larger than the quantity of compressed air discharged from each of the other bags 38*a*, 38*b*, 37*a*, 37*b*, 36*a*, 36*b*, 34, 41*a*, 41*b*, 42*a* and 42*b* than those bags 35 and 39. If the exhaust time set for each of the buttock bag 35 and backbone-line bag 39 is equal to the exhaust time set for each of the other bags 38*a*, 38*b*, 37*a*, 37*b*, 36*a*, 36*b*, 34, 41*a*, 41*b*, 42*a* and 42*b* than those bags 35 and 39, the quantity of compressed air remaining in each of the buttock bag 35 and backbone-line bag 39 is smaller than the quantity of compressed air remaining in each of the other bags than those bags 35 and 39, after the termination of the same exhaust time is up.

As mentioned before, therefore, the exhaust time set in each of the backbone-line bag exhaust timer 70*n* and buttock bag exhaust timer 70*p*, among the exhaust timers 70*l* to 70*r*, is set shorter than the exhaust time set in each of the other exhaust timers 70*l*, 70*m*, 70*o*, 70*q* and 70*r*. By doing this, the quantity of compressed air remaining in each of the buttock bag 35 and backbone-line bag 39 is larger than the quantity of compressed air remaining in each of the other bags than those bags 35 and 39, after the exhaust time for each of the buttock bag 35 and back bone-line bag 39 and each of the other bags 38*a*, 38*b*, 37*a*, 37*b*, 36*a*, 36*b*, 34, 41*a*, 41*b*, 42*a* and 42*b* than those bags 35 and 39 is up.

As a result of this, when the common charging time for the operation modes in which at least one the buttock bag 35 and the backbone-line bag 39 is used is up, the volume of inflation of the buttock bag 35 or backbone-line bag 39 can be made substantially equal to the volume of inflation of each of the other bags than those bags 35 and 39 in the aforesaid operation modes, although the force applied from the body weight of the seated person to each of the bags 35 and 39 is greater than the force applied to each of the other bags. Even in the operation mode in which at least one of the buttock bag 35 and the backbone-line bag 39 is used, therefore, the various bags inflated and deflated in the aforesaid operation modes can press the corresponding parts of the body of the seated person with a uniform strength, thereby providing a satisfactory massage effect.

The present invention is not limited to the embodiments described above. For example, the leg support 33 may be omitted. In the third to sixth embodiments shown in FIGS. 11 to 17, moreover, the various adjusting means (change of the charging time or exhaust time, change of the bag capacity, change of the flow resistance of the charging/exhaust pipe for the bag, etc.) employed for the backbone-line bag 39 may be omitted so that the backbone-line bag 39 can be handled in the same manner as the other bags than the buttock bag 35, and the thigh bag 34 may be provided with adjusting means similar to the various adjusting means (change of the charging time or exhaust time, change of the bag capacity, change of the flow resistance of the charging/exhaust pipe for the bag, etc.) employed for the buttock bag 35.

Further, each of the other bags than the buttock bag 35 and backbone-line bag 39 may be provided with the aforesaid various adjusting means (change of the charging time or exhaust time, change of the bag capacity, change of the flow resistance of the charging/exhaust pipe for the bag, etc.) employed for the buttock bag 35 and backbone-line bag 39, depending on the force applied from the body weight of the seated person to each of those other bags.

Industrial Applicability

A lounger-type air massager according to the present invention inflates and deflates bags by feeding and discharging compressed air into and from the bags, and intermittently presses and massages the body of a user seated on a lounger by means of the bags.

We claim:

1. A lounger-type air massager comprising:

a lounger body including a seat portion and a backrest portion provided on a rear end of the seat portion;

bags provided on the seat portion and the backrest portion and adapted to inflate and deflate when compressed air is fed thereinto and discharged therefrom; and a compressed air control device for controlling feeding and discharging of the compressed air into and from the bags, wherein the compressed air control device sets a same exhaust time for all of the bags and sets a charging time for at least one of the bags, excluding a bag which is subjected to a lightest load from a body weight of a person seated on the lounger body, to be longer than a charging time for each of the other bags.

2. The lounger-type air massager according to claim 1, wherein the at least one of the bags is located on the seat portion so as to be nearest to the backrest portion.

3. The lounger-type air massager according to claim 1, wherein the at least one of the bags is located on the backrest portion and corresponds to muscles along a backbone of the person seated on the lounger body.

4. The lounger-type air massager according to claim 1, wherein the bags include at least one first bag fixed to the seat portion only at a rear edge portion of the first bag located on a backrest portion side of the first bag, and a second bag fixed to the backrest portion only at an upper end portion of the second bag.

5. A lounger-type air massager comprising:

a lounger body including a seat portion and a backrest portion provided on a rear end of the seat portion;

bags provided on the seat portion and the backrest portion and adapted to inflate and deflate when compressed air is fed thereinto and discharged therefrom; and a compressed air control device for controlling feeding and discharging of the compressed air into and from the bags, wherein the compressed air control device sets a same charging time and a same exhaust time for all of the bags, and wherein a capacity of at least one of the bags, excluding a bag which is subjected to a lightest load from a body weight of a person seated on the lounger body, is smaller than a capacity of each of the other bags.

6. The lounger-type air massager according to claim 5, wherein the at least one of the bags is located on the seat portion so as to be nearest to the backrest portion.

7. The lounger-type air massager according to claim 5, wherein the at least one of the bags is located on the backrest portion and corresponds to muscles along a backbone of the person seated on the lounger body.

8. A lounger-type air massager according to claim 5, wherein the bags include at least one first bag fixed to the seat portion only at a rear edge portion of the first bag located on a backrest portion side of the first bag, and a second bag fixed to the backrest portion only at an upper end portion of the second bag.

9. A lounger-type air massager comprising:

a lounger body including a seat portion and a backrest portion provided on a rear end of the seat portion;

bags provided on the seat portion and the backrest portion and adapted to inflate and deflate when compressed air is fed thereinto and discharged therefrom; and a compressed air control device for controlling feeding and discharging of the compressed air into and from the bags, wherein the compressed air control device sets a same charging time and a same exhaust time for all of the bags, and wherein a charging/exhaust resistance of at least one of the bags, excluding a bag which is subjected to a lightest load from a body weight of a person seated on the lounger body, is lower than a charging/exhaust resistance of each of the other bags.

10. The lounger-type air massager according to claim 9, wherein the at least one of the bags is located on the seat portion so as to be nearest to the backrest portion.

11. The lounger-type air massager according to claim 9, wherein the at least one of the bags is located on the backrest portion and corresponds to muscles along a backbone of the person seated on the lounger body.

12. A lounger-type air massager according to claim 9, wherein the bags include at least one first bag fixed to the seat portion only at a rear edge portion of the first bag located on a backrest portion side of the first bag, and a second bag fixed to the backrest portion only at an upper end portion of the second bag.

13. A lounger-type air massager comprising:

a lounger body including a seat portion and a backrest portion provided on a rear end of the seat portion;

bags provided on the seat portion and the backrest portion and adapted to inflate and deflate when compressed air is fed thereinto and discharged therefrom; and a compressed air control device for controlling feeding and discharging of the compressed air into and from the bags, wherein the compressed air control device sets a same charging time for all of the bags, and sets an exhaust time for at least one of the bags, excluding a bag which is subjected to a lightest load from a body weight of a person seated on the lounger body, to be shorter than an exhaust time for each of the other bags.

14. The lounger-type air massager according to claim 13, wherein the at least one of the bags is located on the seat portion so as to be nearest to the backrest portion.

15. The lounger-type air massager according to claim 13, wherein the at least one of the bags is located on the backrest portion and corresponds to muscles along a backbone of the person seated on the lounger body.

16. A lounger-type air massager according to claim 13, wherein the bags include at least one first bag fixed to the seat portion only at a rear edge portion of the first bag located on a backrest portion side of the first bag, and a second bag fixed to the backrest portion only at an upper end portion of the second bag.

* * * * *